US010759557B2

(12) United States Patent
Berger et al.

(10) Patent No.: US 10,759,557 B2
(45) Date of Patent: Sep. 1, 2020

(54) AUTOMATED SANDWICH WRAPPING SYSTEM

(71) Applicant: Solbern Inc., Fairfield, NJ (US)

(72) Inventors: Thomas G. Berger, Ridgefield, NJ (US); George Stephens, Hewitt, NJ (US)

(73) Assignee: Solbern Inc., Fairfield, NJ (US)

( * ) Notice: Subject to any disclaimer, the term of this patent is extended or adjusted under 35 U.S.C. 154(b) by 796 days.

(21) Appl. No.: 15/219,651

(22) Filed: Jul. 26, 2016

(65) Prior Publication Data

US 2017/0043888 A1 Feb. 16, 2017

Related U.S. Application Data

(60) Provisional application No. 62/204,085, filed on Aug. 12, 2015.

(51) Int. Cl.

| | |
|---|---|
| ***B65B 11/04*** | (2006.01) |
| ***B65B 57/00*** | (2006.01) |
| ***B65B 11/00*** | (2006.01) |
| ***B65B 45/00*** | (2006.01) |
| ***B65B 25/16*** | (2006.01) |
| ***B65B 11/48*** | (2006.01) |
| *B65B 67/10* | (2006.01) |

(52) U.S. Cl.

CPC ..... *B65B 57/00* (2013.01); *B65B 11/004* (2013.01); *B65B 11/48* (2013.01); *B65B 25/16* (2013.01); *B65B 45/00* (2013.01); *B65B 67/10* (2013.01)

(58) Field of Classification Search

CPC ..... B65B 11/004; B65B 11/04; B65B 11/56; B65B 45/00; B65B 49/08; B65D 75/00; B31F 1/0006; B31F 1/0016; B31F 1/0029; B31F 5/005

USPC ..... 53/209, 210, 211, 214, 216, 218, 206, 53/203; 493/426, 429, 431, 405, 416, 493/422, 427, 434, 442, 454

See application file for complete search history.

(56) References Cited

U.S. PATENT DOCUMENTS

| | | | | |
|---|---|---|---|---|
| 4,608,919 | A * | 9/1986 | Prows | A21C 9/063 99/450.2 |
| 4,913,043 | A * | 4/1990 | Cheung | A21C 9/063 425/110 |
| 5,263,407 | A * | 11/1993 | Pomara, Jr. | A23P 20/20 99/450.6 |
| 6,263,789 | B1 * | 7/2001 | Karner | A21C 9/063 99/325 |
| 2006/0144254 | A1 * | 7/2006 | Foulon, Jr. | A21C 9/063 99/450.4 |
| 2013/0067858 | A1 * | 3/2013 | Spears | B65B 3/10 53/122 |

* cited by examiner

*Primary Examiner* — Chelsea E Stinson
*Assistant Examiner* — Mary C Hibbert-Copeland
(74) *Attorney, Agent, or Firm* — McCarter & English, LLP

(57) ABSTRACT

An automated sandwich wrapping system is disclosed herein. In some embodiments, an automated sandwich wrapping system includes a folding subassembly having a plurality of folding plates to inwardly fold side portions of sandwich wrapping paper extending past ends of a sandwich, a roller subassembly having at least one roller to rotate the sandwich to wrap the sandwich, and a controller preprogrammed to control and coordinate operation of the folding subassembly and the roller subassembly. The folding plates move between an idle position and an active position.

20 Claims, 22 Drawing Sheets

AUTOMATED SANDWICH WRAPPING SYSTEM

CROSS-REFERENCE TO RELATED APPLICATIONS

The present application claims the priority benefit of U.S. Provisional Application No. 62/204,085, filed Aug. 12, 2015, which is incorporated by reference in its entirety.

FIELD OF THE DISCLOSURE

Embodiments of the present disclosure relate to wrapping systems and, more specifically, to an automated sandwich wrapping system.

BACKGROUND

Sandwiches (and other hand held food products) are often wrapped for transportation purposes, particularly for submarine sandwiches (e.g., sub, wedge, hoagie, hero, grinder, baguette, and the like). Wrapping can be an expensive and time intensive process, particularly for entities with high volumes of sandwich production (e.g., for manufacturers supplying large chain stores). Further, wrapping by hand can have inconsistent results and can also have associated health issues due to the repetitive motion required. Thus, a need exists for a system that wraps sandwiches more quickly than wrapping sandwiches solely by hand, among other things. These and/or other needs are addressed by embodiments of the automated sandwich wrapping system of the present disclosure.

SUMMARY

The present disclosure is directed to an automated sandwich wrapping system. Disclosed herein is an automated sandwich wrapping system including a folding subassembly having a plurality of folding plates to inwardly fold side portions of sandwich wrapping paper extending past ends of a sandwich, a roller subassembly to rotate the sandwich to wrap the sandwich, and a controller preprogrammed to control and coordinate operation of the folding subassembly and the roller subassembly.

Also disclosed herein is an automated sandwich wrapping system including a sandwich wrapping paper support subassembly to feed the sandwich wrapping paper during wrapping, a creasing blade subassembly to crease side portions of sandwich wrapping paper extending past ends of a sandwich, a left folding subassembly and a right folding subassembly to inwardly fold left side portions of sandwich wrapping paper extending past ends of the sandwich, a lower roller subassembly and an upper roller subassembly to rotate the sandwich to wrap the sandwich, and a controller. The controller is preprogrammed to control and coordinate operation of the creasing blade subassembly, the left folding subassembly, the right folding subassembly, the lower roller subassembly, and the upper roller subassembly. The lower roller subassembly and the upper roller subassembly have a plurality of rollers to rotate the sandwich to wrap the sandwich. The left folding subassembly is positioned adjacent to a left side of the sandwich wrapping paper support assembly, and the right folding subassembly is positioned adjacent a right side of the sandwich wrapping paper support assembly.

Also disclosed herein is an automated method of wrapping a sandwich including introducing the sandwich into an automated sandwich wrapping system, the automated sandwich wrapping system including a folding subassembly having a plurality of folding plates, a roller subassembly having at least one roller, and a controller. The method includes controlling and coordinating operation of the folding subassembly with the controller to move one or more of the plurality of folding plates of the folding subassembly between an idle position and an active position to inwardly fold side portions of sandwich wrapping paper extending past ends of the sandwich. The method includes controlling and coordinating operation of the roller subassembly with the controller to rotate the sandwich with the at least one roller of the roller subassembly to wrap the sandwich.

BRIEF DESCRIPTION OF THE DRAWINGS

The foregoing features of the invention will be apparent from the following Detailed Description, taken in connection with the accompanying drawings, in which.

DETAILED DESCRIPTION

It should be understood that the relative terminology used herein, such as "front", "rear", "left", "top", "bottom", "vertical", and "horizontal" is solely for the purposes of clarity and designation and is not intended to limit the invention to embodiments having a particular position and/or orientation. Accordingly, such relative terminology should not be construed to limit the scope of the present invention. In addition, it should be understood that the invention is not limited to embodiments having specific dimensions. Thus, any dimensions provided herein are merely for an exemplary purpose and are not intended to limit the invention to embodiments having particular dimensions.

Disclosed herein is an automated sandwich wrapping system. Although an automated sandwich wrapping system is described, the wrapping system can be used for other wrapping purposes aside from sandwiches (e.g., gift wrapping). The automated sandwich wrapping system can reduce the time for sandwich processing by automating sandwich wrapping and/or can reduce the resources needed to timely prepare sandwich orders. Additionally, the automated sandwich wrapping system can provide a consistent finished size and appearance, while also reducing potential health issues associated with repetitive motion for employees. Although the automated sandwich wrapping system is described specifically with respect to submarine sandwiches (e.g., sub, wedge, hoagie, hero, grinder, baguette, and the like), the automated sandwich wrapping system can be used with any type of sandwich or other food item.

Figure 1:
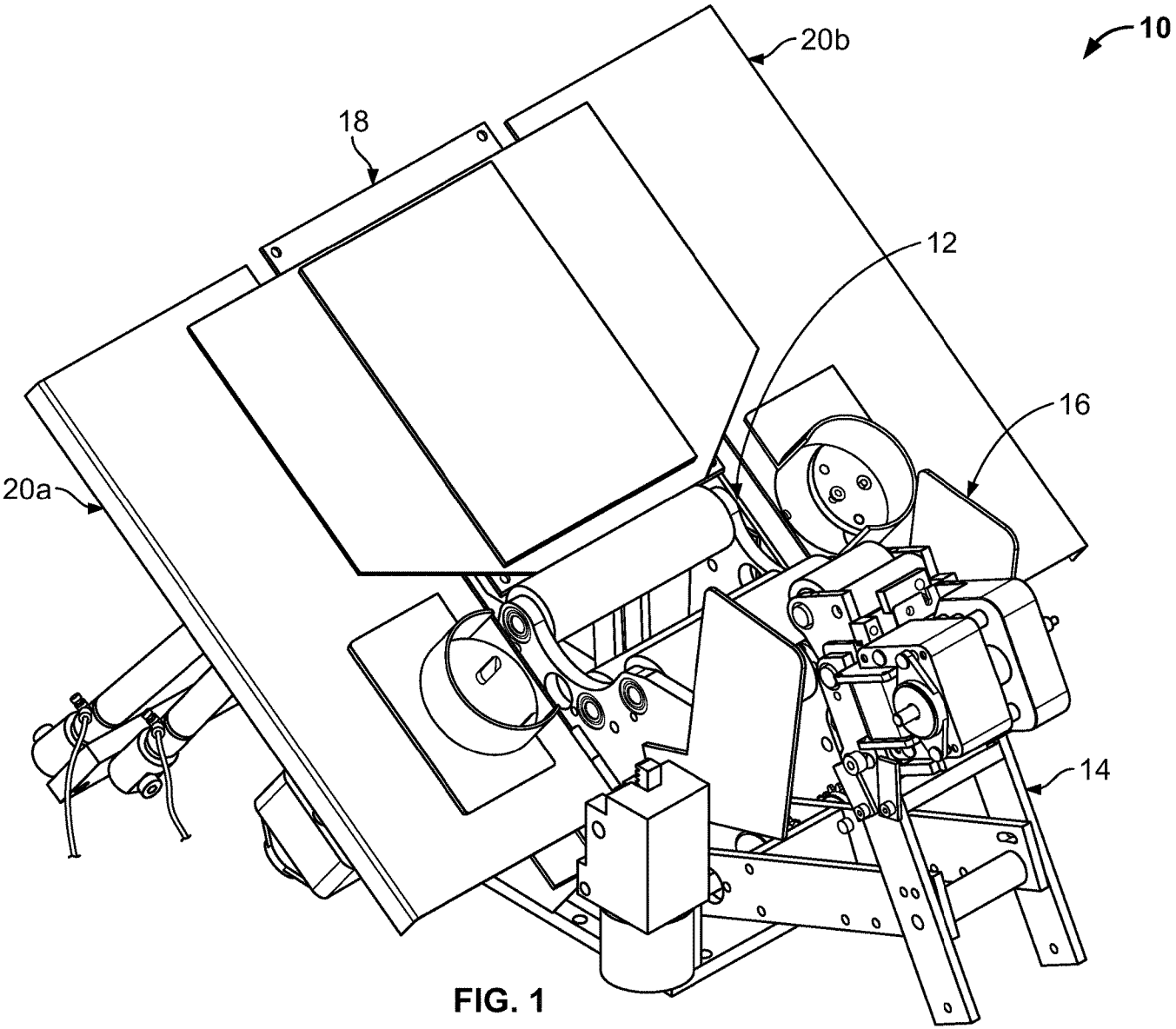
FIG. 1 is a front perspective view of an embodiment of an automated sandwich wrapping system having a lower roller subassembly, an upper roller subassembly pivotable from an open position to a closed position, a creasing blade subassembly rotatable from a front vertical position to a rear horizontal position, a sandwich wrapping paper support subassembly having a left folding flap and a right folding flap movable from a coplanar position to a perpendicular position to a folded position, a left folding subassembly, and a right folding subassembly, the left folding subassembly and right folding subassembly each have an upper folding plate movable from an idle position to an active position, a lower folding plate movable from an idle position to an active position, and an extendable plunger arm movable from a retracted position to an extended position.
Figure 2:
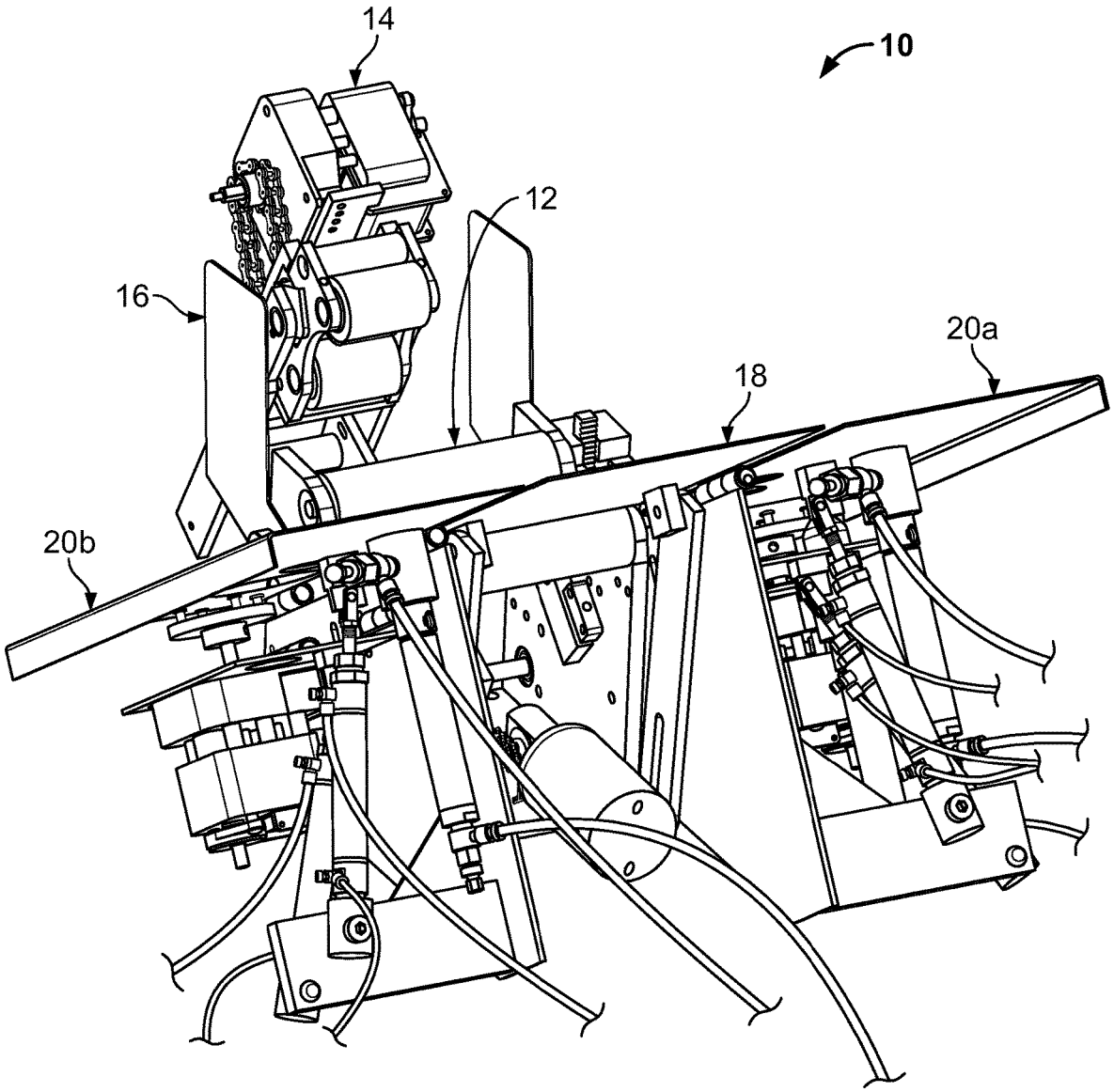
FIG. 2 is a rear perspective view of an embodiment of the automated sandwich wrapping system of FIG. 1.

FIGS. 1-2 are perspective views of an automated sandwich wrapping system 10. More specifically, FIG. 1 is a front perspective view of an embodiment of an automated sandwich wrapping system having a lower roller subassembly, an upper roller subassembly pivotable from an open position to a closed position, a creasing blade subassembly rotatable from a front vertical position to a rear horizontal position, a sandwich wrapping paper support subassembly having a left folding flap and a right folding flap movable from a coplanar position to a perpendicular position to a folded position, a left folding subassembly, and a right folding subassembly, the left folding subassembly and right folding subassembly each have an upper folding plate movable from an idle position to an active position, a lower folding plate movable from an idle position to an active position, and an extendable plunger arm movable from a retracted position to an extended position, and FIG. 2 is a rear perspective view of an embodiment of the automated sandwich wrapping system of FIG. 1.

The automated sandwich wrapping system 10 includes a lower roller subassembly 12, an upper roller subassembly 14, a creasing blade subassembly 16, a sandwich wrapping paper support subassembly 18, a left folding subassembly 20*a*, and a right folding subassembly 20*b*. The lower roller subassembly 12, the upper roller subassembly 14, the creasing blade subassembly 16, and the sandwich wrapping paper support subassembly 18 are positioned between the left folding subassembly 20*a* and the right folding subassembly 20*b*. The upper roller subassembly 14 is positioned towards a front of the automated sandwich wrapping system 10 and pivotally attached to the lower roller subassembly 12. The sandwich wrapping paper support subassembly 18 is positioned towards a rear of the automated sandwich wrapping system 10 and adjacent to the lower roller subassembly 12, such that the lower roller subassembly 12 is positioned between the upper roller subassembly 14 and the sandwich wrapping paper support assembly 18. The creasing blade subassembly 16 is pivotally interconnected with a front portion of the lower roller subassembly 12. One or more electronic controllers (e.g., local controller, remote controller, process controller, and the like) can be in electronic communication with components of the automated sandwich wrapping system 10 to control movement and operation thereof. More specifically, the electronic controller can control actuation of pistons, motors, and the like (as described herein) of the automated sandwich wrapping system 10 to control (e.g., induce movement of) and synchronize (e.g., coordinate) the movement (e.g., duration of movement, timing of movement, and the like) of one or more components of the lower roller subassembly 12, the upper roller subassembly 14, the creasing blade subassembly 16, the sandwich wrapping paper support subassembly 18, the left folding subassembly 20*a*, and/or the right folding subassembly 20*b*. Accordingly, the electronic controller can be preprogrammed for timed synchronization and/or at least partial automation of various components of the automated sandwich wrapping system 10.

Figure 3:
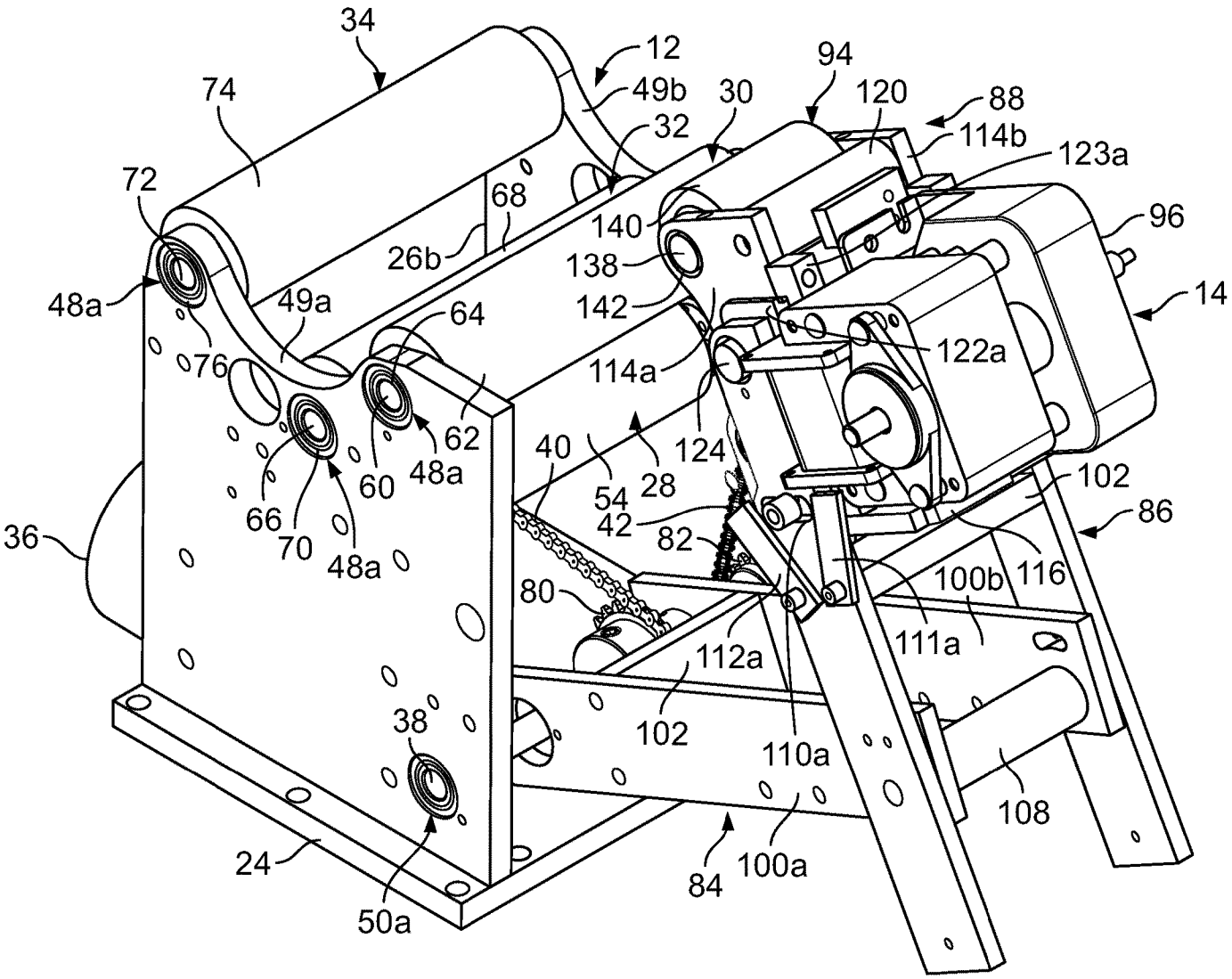
FIG. 3 is a front perspective view of an embodiment of the lower roller subassembly and upper roller subassembly of the automated sandwich wrapping system of FIGS. 1-2.
Figure 4:
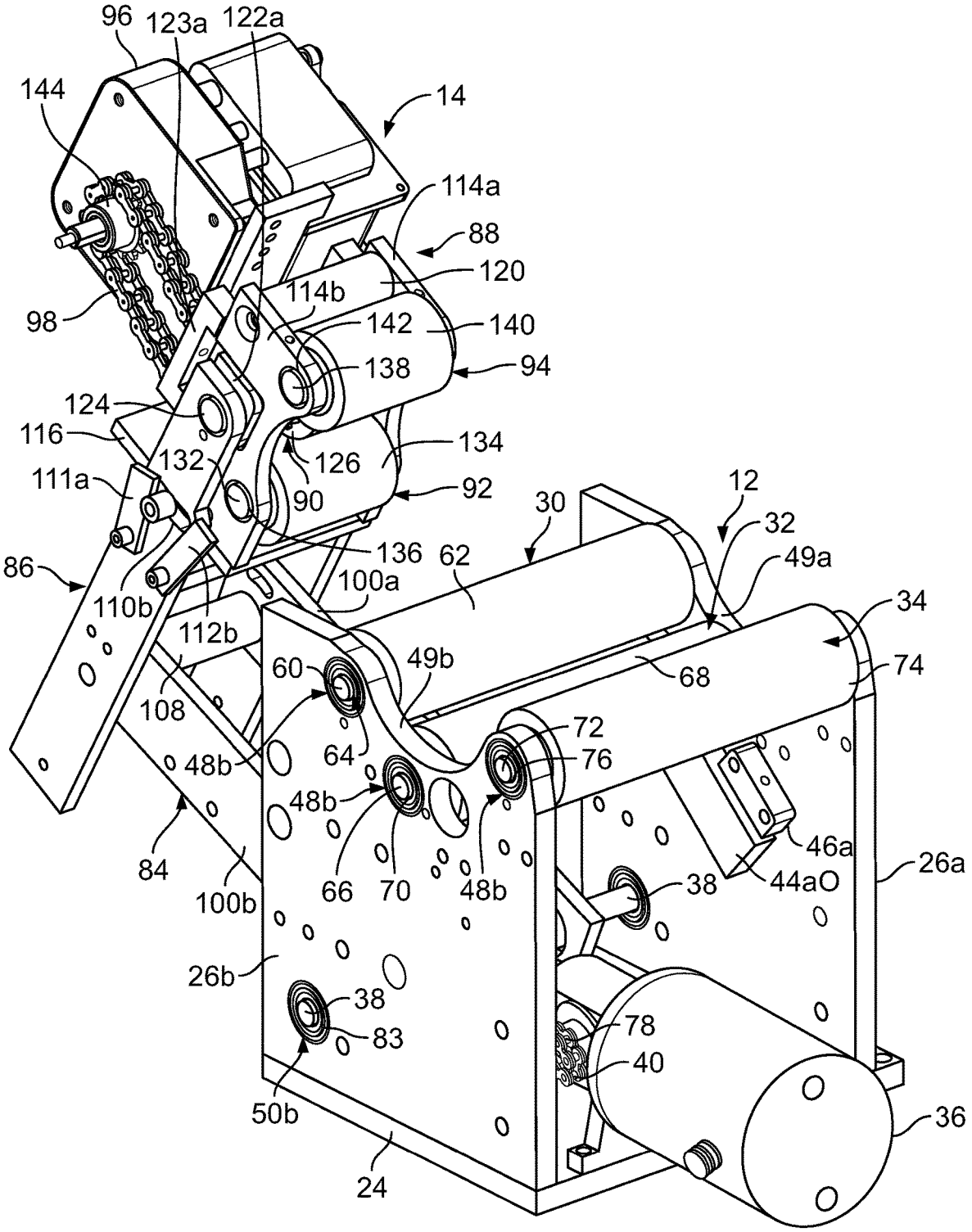
FIG. 4 is a rear perspective view of an embodiment of the lower roller subassembly and upper roller subassembly of FIGS. 1-3.

FIGS. 3-6 are views of the lower roller subassembly 12 and upper roller subassembly 14 of the automated sandwich wrapping system 10. More specifically, FIG. 3 is a front perspective view of an embodiment of the lower roller subassembly and upper roller subassembly of the automated sandwich wrapping system of FIGS. 1-2, FIG. 4 is a rear perspective view of an embodiment of the lower roller subassembly and upper roller subassembly of FIGS. 1-3, FIG. 5 is a front elevation view of an embodiment of the lower roller subassembly and upper roller subassembly of FIGS. 1-3, and FIG. 6 is a sectional view of an embodiment of the lower roller subassembly and upper roller subassembly of FIG. 3 taken along section line 6-6 of FIG. 5. The upper roller subassembly 14 is pivotally connected to the lower roller subassembly 12. The upper roller subassembly 14 and lower roller subassembly 12 cooperate with one another to secure a sandwich between rollers thereof. At least one of the rollers of the upper roller subassembly 14 and lower roller subassembly 12 is driven by a motor so that the rollers of the upper roller subassembly 14 and lower roller subassembly 12 rotate together to roll the sandwich and sandwich wrapping paper, thereby wrapping the sandwich in the sandwich wrapping paper. A variety of motors can be used to drive the upper roller assembly 14 and/or the lower roller assembly 12, such as one or more stepper motors, one or more a gear motors, combinations thereof, or the like.

Figure 6:
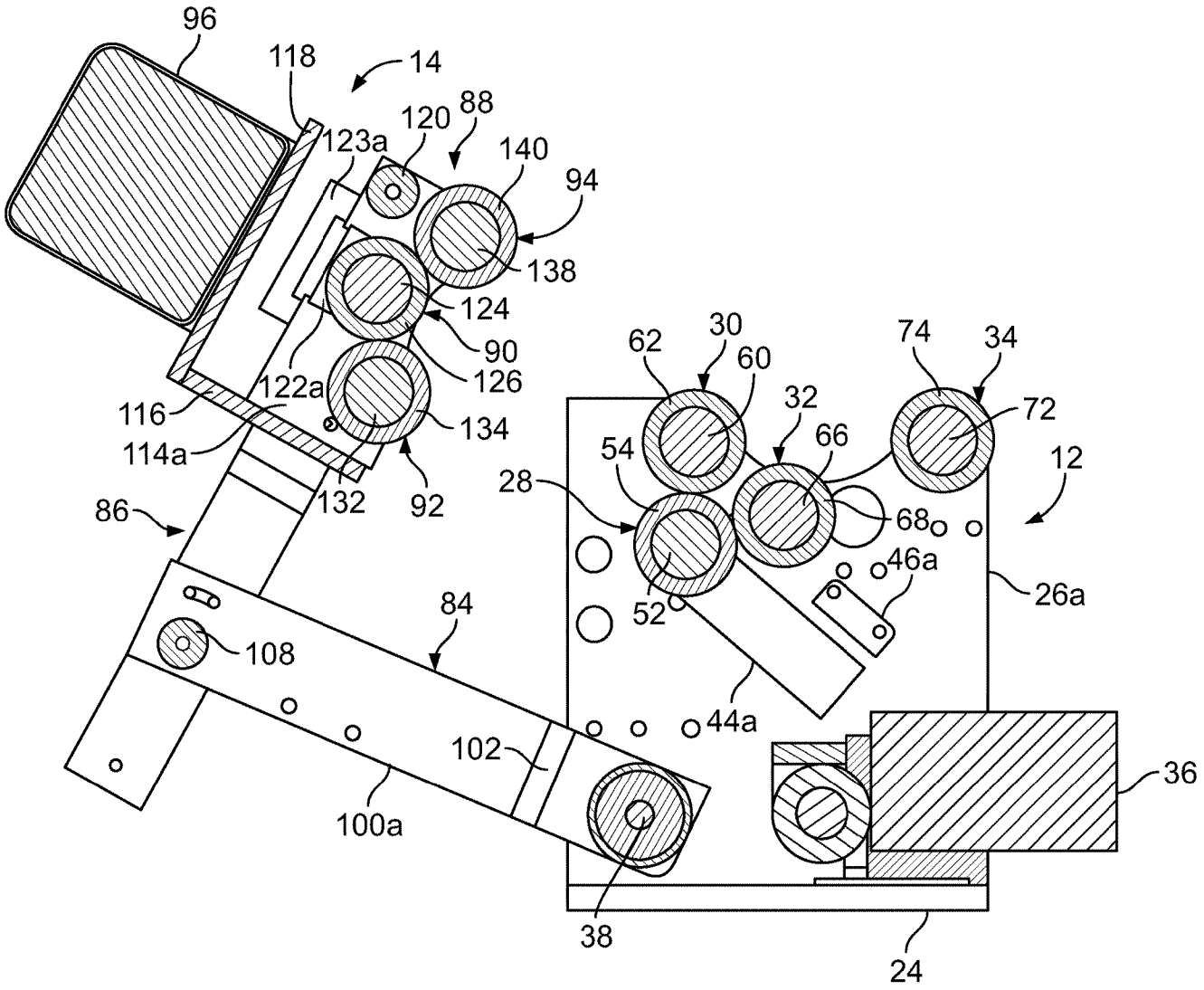
FIG. 6 is a sectional view of an embodiment of the lower roller subassembly and upper roller subassembly of FIG. 3 taken along section line 6-6 of FIG. 5.

The lower roller subassembly 12 is provided with (e.g., includes) a base bottom wall 24, a base left sidewall 26*a* mounted to the base bottom wall 24, and a base right sidewall 26*b* mounted to the base bottom wall 24. As shown in FIG. 6, for example, the lower roller assembly 12 also includes a lower driver roller 28 (e.g., lower input roller), a first lower driven roller 30 (e.g., first lower output roller), a second lower driven roller 32 (e.g., second lower output roller), and a lower support roller 34. The lower roller assembly 12 further includes a lower roller drive motor 36, a compound train axle 38, a first lower roller drive chain 40, and a second lower roller drive chain 42 (e.g., as shown in FIG. 3).

As shown in FIG. 3, for example, the base left sidewall 26*a* is positioned towards a left side (e.g., first side), and attached to a top surface, of the base bottom wall 24. The base right sidewall 26*b* is positioned towards a right side (e.g., second side), and attached to a top surface, of the base bottom wall 24 opposite to the left side of the base bottom wall 24. In some embodiments, the base left sidewall 26*a* can define a left arc 49*a* in a top edge thereof. Similarly, the base right sidewall 26*b* can define a right arc 49*b* in a top edge thereof. The base left sidewall 26*a* (and the left arc 49*a* thereof) can be aligned with the base right sidewall 26*b* (and the right arc 49*b* thereof).

As shown in FIGS. 4 and 6, the base left sidewall 26*a* can include a left pressure arm 44*a*, a left pressure block 46*a*, one or more left roller openings 48*a*, and a left compound train axle opening 50*a*. The left pressure arm 44*a* and left pressure block 46*a* can be angularly mounted on an inside surface of the base left sidewall 26*a* (e.g., on the surface closer to the base right sidewall 26*b*). The left pressure arm 44*a* can be mounted adjacent to and below (e.g., closer to the base bottom wall 12 than) the left pressure block 46*a*. Further, the left pressure arm 44*a* can be mounted (e.g., spring mounted) to the base left sidewall 26*a* such that the left pressure arm 44*a* is biased to pivot up (e.g., away from the base bottom wall 12). More specifically, a first end of the left pressure arm 44*b* is pivotally mounted and a second end of the left pressure arm 44*b* rotates about the pivot point of the first end. Accordingly, the left pressure block 46*a* serves as a pivot limit for the left pressure arm 44*a* (e.g., a point by which the left pressure arm 44*a* cannot move beyond).

The one or more left roller openings 48*a* of the base left sidewall 26*a* can be positioned along the left arc 49*a* of the base left sidewall 26*a*. More specifically, a first and second left roller opening 48*a* can be adjacently positioned towards a front of the base left sidewall 26*a*, and a third left roller opening can be positioned towards a rear of the of the base left sidewall 26*a*, where all of the first, second, and third left roller openings 48*a* are positioned along the left arc 49*a*. The left compound train axle opening 50*a* can be disposed towards a front lower portion of the base left sidewall 26*a* (e.g., lower than the one or more left roller openings 48*a*).

Figure 5:
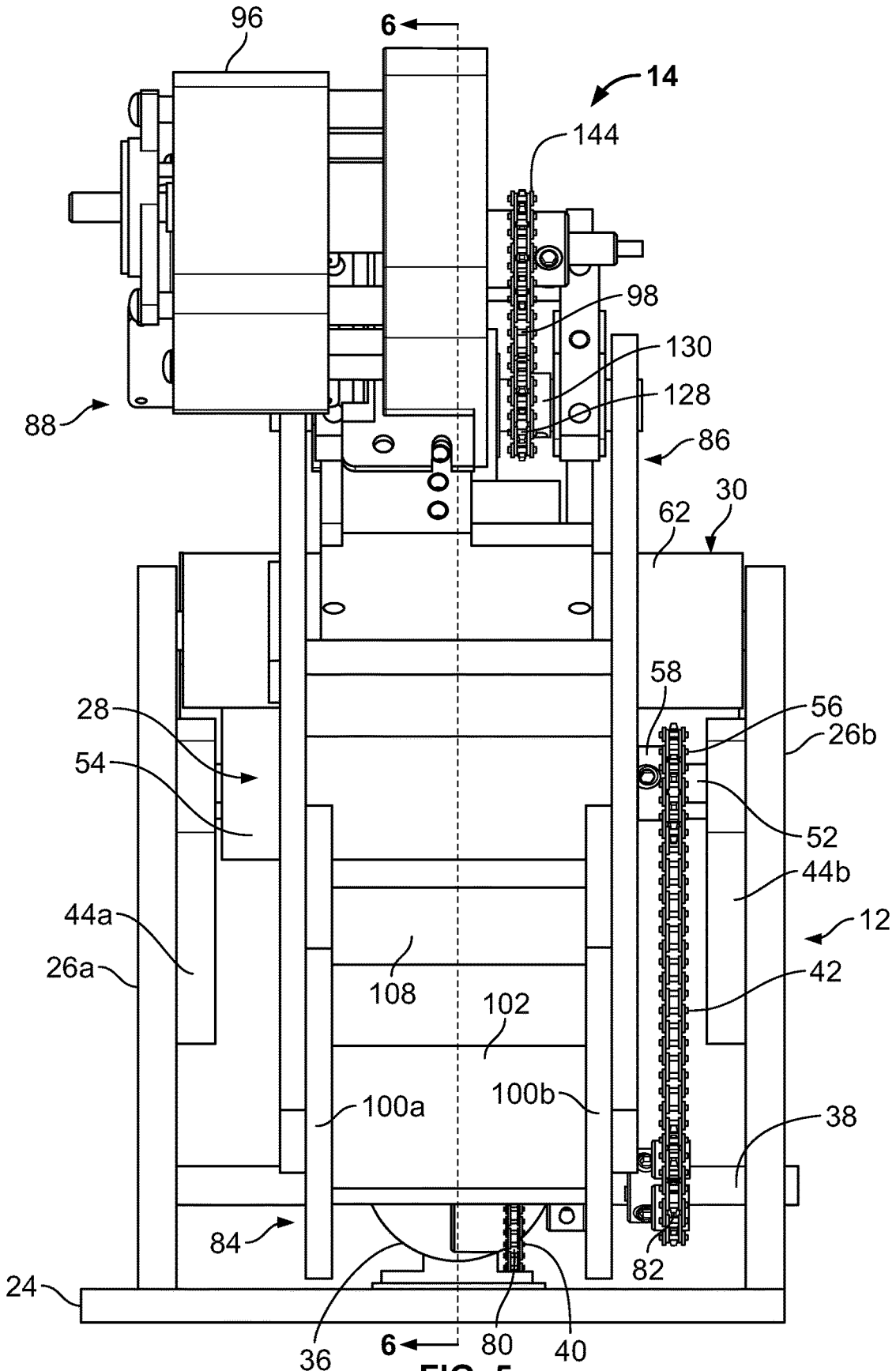
FIG. 5 is a front elevation view of an embodiment of the lower roller subassembly and upper roller subassembly of FIGS. 1-3.

Similarly, as shown in FIG. 4, for example, the base right sidewall 26*b* can include a right pressure arm 44*b*, a right pressure block 46*b*, one or more right roller openings 48*b*, and a right compound train axle opening 50*b*. The right pressure arm 44*b* and right pressure block 46*b* (not shown) can be angularly mounted on an inside surface of the base right sidewall 26*b* (e.g., on the surface closer to the base left sidewall 26*a*). The right pressure arm 44*b* can be mounted adjacent to and below (e.g., closer to the base bottom wall 12 than) the right pressure block 46*b*. Further, the right pressure arm 44*b* (e.g., as shown in FIG. 5) can be mounted (e.g., spring mounted) to the base right sidewall 26*b* such that the right pressure arm 44*b* is biased to pivot up (e.g., away from the base bottom wall 12). More specifically, a first end of the right pressure arm 44*b* is pivotally mounted and a second end of the right pressure arm 44*b* rotates about the pivot point of the first end. Accordingly, the right pressure block 46*b* serves as a pivot limit for the right pressure arm 44*b* (e.g., a point by which the right pressure arm 44*b* cannot move beyond).

The one or more right roller openings 48*b* of the base right sidewall 26*b* can be positioned along the right arc 49*b* of the base left sidewall 26*b*. More specifically, a first and second left roller opening 48*b* can be adjacently positioned towards a front of the base right sidewall 26*b*, and a third right roller opening can be positioned towards a rear of the of the base right sidewall 26*b*, where all of the first, second, and third right roller openings 48*b* are positioned along the right arc 49*b*. The right compound train axle opening 50*b* can be disposed towards a front lower portion of the base right sidewall 26*b* (e.g., lower than the one or more right roller openings 48*b*).

One or more features of the base left sidewall 26*a* and the base right sidewall 26*b* described above can be horizontally aligned (e.g., mirrored) with one another. More specifically, the left pressure arm 44*a* can be aligned with the right pressure arm 44*b*, the left pressure block 46*a* can be aligned with the right pressure block 46*b*, the one or more left roller openings 48*a* can be aligned with the one or more right roller openings 48*b*, and the left compound train axle opening 50*a* can be aligned with the right compound train axle opening 50*b*.

As shown in FIG. 6, for example, the lower driver roller 28 can include a lower driver roller axle 52, a lower driver roller covering 54 positioned about the lower driver roller axle 52, a lower driver roller sprocket 56 positioned about and fixedly attached (e.g., by a set screw and/or collar) to the lower driver roller axle 52, and lower driver roller mounting components 58. The lower driver roller covering 54 does not cover the entire length of the lower driver roller axle 52, and more specifically, the lower driver roller covering 54 does not cover the portion of the lower driver roller axle 52 where the lower driver roller sprocket 56 is attached. The lower driver roller sprocket 56 can be fixedly attached towards a right side of the lower driver roller axle 52. A left end (e.g., a first end) of the lower driver roller 28 can be rotatably mounted (by lower driver roller mounting components 58) to a second end of the left pressure arm 44*a* of the base left sidewall 26*a*, and a right end (e.g., a second end) of the lower driver roller 28 can be rotatably mounted (by lower driver roller mounting components 58) to the second end of the right pressure arm 44*b* of the base right sidewall 26*b*. Accordingly, the lower driver roller 28 pivots along with the second ends of the left pressure arm 44*a* and the right pivot arm 44*b* and is biased upwardly (e.g., and rearwardly) by the left pressure arm 44*a* and right pressure arm 44*b*. The lower driver roller mounting components 58 can include ball bearings, nuts, washers, screws, and the like.

The first lower driven roller 30 can include a first lower driven roller axle 60, a first lower driven roller covering 62 positioned about the first lower driver roller axle 60, and first lower driven roller mounting components 64. The first lower driver roller covering 54 can cover substantially the entire length of the first lower driven roller axle 52. A left end (e.g., a first end) of the first lower driven roller 30 can be rotatably mounted (by first lower driven roller mounting components 64) to one of the left roller opening 48*a* of the base left sidewall 26*a*, and a right end (e.g., a second end) of the first lower driven roller 30 can be rotatably mounted (by first lower driven roller mounting components 64) to one of the right roller openings 48*b* of the base right sidewall 26*b*. The first lower driven roller mounting components 64 can include ball bearings, nuts, washers, screws, and the like.

The second lower driven roller 32 can include a second lower driven roller axle 66, a second lower driven roller covering 68 positioned about the second lower driver roller axle 66, and second lower driven roller mounting components 70. The second lower driver roller covering 68 can cover substantially the entire length of the second lower driven roller axle 66. A left end (e.g., a first end) of the second lower driven roller 32 can be rotatably mounted (by second lower driven roller mounting components 70) to one of the left roller opening 48*a* of the base left sidewall 26*a*, and a right end (e.g., a second end) of the second lower driven roller 32 can be rotatably mounted (by second lower driven roller mounting components 70) to one of the right roller openings 48*b* of the base right sidewall 26*b*. The second lower driven roller mounting components 70 can include ball bearings, nuts, washers, screws, and the like.

The lower support roller 34 can include a lower support roller axle 72, a lower support roller covering 74 positioned about the lower support roller axle 72, and lower support roller mounting components 76. The lower support roller covering 74 can cover substantially the entire length of the lower support roller axle 72. A left end (e.g., a first end) of the lower support roller 34 can be rotatably mounted (by lower support roller mounting components 76) to one of the left roller opening 48*a* of the base left sidewall 26*a*, and a right end (e.g., a second end) of the lower support roller 32 can be rotatably mounted (by lower support roller mounting components 76) to one of the right roller openings 48*b* of the base right sidewall 26*b*. The lower support roller mounting components 76 can include ball bearings, nuts, washers, screws, and the like.

Accordingly, the first lower driven roller 30, the second lower driven roller 32, and the lower support roller 34 are positioned about the left arc of the base left sidewall 26*a* and the right arc of the base right sidewall 26*b*. More specifically, the first lower driven roller 30 is positioned at a front end of the lower roller subassembly 12 approximately at a front end of the left arc 49*a* and right arc 49*b*, the lower support roller 34 is positioned at a rear end of the lower roller subassembly 12 opposite the first lower driven roller 30 approximately at a rear end of the left arc 49*a* and right arc 49*b*, and the second lower driven roller 32 is positioned between, and lower than, the first lower driven roller 30 and the lower support roller 34 (e.g., at a lower point of the left arc 49*a* and the right arc 49*b*). Further, the lower drive roller 28 is biased upwardly (e.g., and rearwardly) to make and maintain contact with at least one of the first lower driven roller 30 and/or the second lower driven roller 32, where the first lower driven roller 30 and the second lower driven roller 32 do not make contact with each other. As a result, rotation of the lower drive roller 28 drives rotation of both the first lower driven roller 30 and/or the second lower driven roller 32 in a direction opposite to that of the lower drive roller 28. The lower drive roller 28, first lower driven roller 30, and/or the second lower driven roller 32 have the same surface speed (as a result of direct contact), and have the same rotational speed if the lower drive roller 28, first lower driven roller 30, and/or the second lower driven roller 32 are the same size (e.g., have the same diameter as one another).

The lower roller drive motor 36 can be mounted to the base bottom wall 24 and at least partially positioned between the base left sidewall 26*a* and the base right sidewall 26*b*. The lower roller drive motor 36 includes a lower roller drive motor sprocket 78 which provides rotational output of the lower roller drive motor 36.

The compound train axle 38 (e.g., as shown in FIG. 5) is mounted to base left sidewall 26*a* and the base right sidewall 26*b*. More specifically, a left end (e.g., first end) of the compound train axle 38 is rotatably mounted to the left compound train axle opening 50*a* (e.g., by compound train axle mounting components 83) and a right end (e.g., second end) of the compound train axle 38 is rotatably mounted to the right compound train axle opening (e.g., by compound train axle mounting components 83). The compound train axle mounting components 83 can include ball bearings, nuts, washers, screws, and the like.

The compound train axle 38 includes a first intermediate sprocket 80 and a second intermediate sprocket 82, each fixedly attached to the compound train axle 38 (e.g., by a set screw and/or collar). The first intermediate sprocket 80 is aligned with the lower roller drive motor sprocket 78 of the lower roller drive motor 36, and the second intermediate sprocket 82 is aligned with the lower driver roller sprocket 56. Accordingly, the second intermediate sprocket 82 is disposed towards the right side of the compound train axle 38. The first lower roller drive chain 40 mechanically connects the lower roller drive motor sprocket 78 with the first intermediate sprocket 80. The second lower roller drive chain 42 mechanically connects the second intermediate sprocket 82 with the lower drive roller sprocket 56. The sizes of one or more of the lower driver roller sprocket 56, the lower roller drive motor sprocket 78, the first intermediate sprocket 80, and/or the second intermediate sprocket 82 can be varied to alter the performance of the gear train (e.g., the speed ratio, mechanical advantage, and the like.).

Accordingly, mechanical power is transferred through the gear train from the lower roller drive motor 36 to the lower roller drive motor sprocket 78 to the first lower roller drive chain 40 to the first intermediate sprocket 80 to the compound train axle 38 to the second intermediate sprocket 82 to the second lower roller drive chain 42 to the lower driver roller sprocket 56 to the lower driver roller 28 to both the first lower driven roller 30 and the second lower driven roller 32. Thereby, the lower roller drive motor 36 provides rotational power and energy to the first lower driven roller 30 and second lower driven roller 32. The resulting speed of the first lower driven roller 30 and second lower driven roller 32 being dependent upon the power output of the lower roller drive motor 36 and the gear train characteristics (e.g., sizes of sprockets, sizes of rollers, and the like).

As shown in FIG. 6, for example, the upper roller subassembly 14 is pivotably connected to the lower roller subassembly 12 and cooperates therewith. The upper roller subassembly 14 pivots between an open position and a closed position. When the upper roller subassembly 14 is in an open position, a sandwich and sandwich wrapping paper can be positioned on the lower roller subassembly 12 (prior to rolling) or removed from the lower roller subassembly 12 (after the sandwich wrapping paper has been wrapped around the sandwich). When the upper roller subassembly 14 is in the closed position, the sandwich and sandwich wrapping paper are secured between the upper roller subassembly 14 and the lower subassembly 12. Once a sandwich and sandwich wrapping paper is secured between the upper roller subassembly 14 and the lower roller subassembly 12, the rollers of the upper roller subassembly 14 and/or lower roller subassembly 12 rotate (as driven by one or more motors) to wrap the sandwich in the sandwich wrapping paper.

The upper roller subassembly 14 includes a lower vertical arm 84, an upper horizontal arm 86, an upper roller mount 88, an upper driver roller 90 (e.g., upper input roller), a first upper driven roller 92 (e.g., first upper output roller), a second upper driven roller 94 (e.g., second upper output roller 94), an upper roller drive motor 96, and an upper roller drive chain 98.

As shown in FIGS. 3-4, for example, the lower vertical arm 84 includes a lower vertical arm left sidewall 100*a*, a lower vertical arm right sidewall 100*b* aligned with the lower vertical arm left sidewall, one or more lower vertical arm support struts 102 therebetween, and one or more lower vertical arm mounting components 104. The lower vertical arm support struts 102 facilitate structural stability of the lower vertical arm 84. The lower vertical arm 84 is rotatably mounted to the compound train axle 38 by the one or more lower vertical arm mounting components 104 (e.g., ball bearings, nuts, washers, screws, and the like). As a result, rotation of the compound train axle 38 is independent of movement of the vertical arm 84 of the upper roller subassembly 14.

The upper horizontal arm 86 includes an upper horizontal arm left sidewall 106*a*, an upper horizontal arm right sidewall 106*b* aligned with the upper horizontal arm left sidewall, and one or more upper horizontal arm support struts 108 therebetween (e.g., where one or more of the support struts can be positioned between the lower vertical arm left sidewall 100*a* and lower vertical arm right sidewall 100*b* and also positioned between the upper horizontal arm left sidewall 106*a* and upper horizontal arm right sidewall 106*b*). The upper horizontal arm support struts 108 facilitate structural stability of the lower vertical arm 84. The first end of the upper horizontal arm 86 can be fixedly attached to the lower vertical arm 84. For example, mounting components (e.g., nuts, bolts, screws, and the like) can be inserted through one or more holes in the upper horizontal arm 86 and/or the lower vertical arm 84. The upper horizontal arm left sidewall 106*a* includes a left limiter slot 110*a* and upper horizontal arm right sidewall 106*b* includes a right limiter slot 110*b*. The left limiter slot 110*a* and right limiter slot 110*b* are aligned with one another and can be arc-shaped.

A left upper limiter panel 111*a* and a left lower limiter panel 112*a* can each be rotatably attached to the upper horizontal arm left sidewall 106*a*. More specifically, a first end of the left upper limiter panel 111*a* can be pivotally attached to the upper horizontal arm left sidewall 106*a* such that a second end of the left upper limiter panel 111*a* can be rotatably positioned to cover at least a portion of the upper portion of the left limiter slot 110*a*. Similarly, a first end of the left lower limiter panel 112*a* can be pivotally attached to the upper horizontal arm left sidewall 106*a* such that a second end of the left lower limiter panel 112*a* can be rotatably positioned to cover at least a portion of the lower portion of the left limiter slot 110*a*.

A right upper limiter panel 111*b* and a right lower limiter panel 112*b* can each be rotatably attached to the upper horizontal arm right sidewall 106*b*. More specifically, a first end of the right upper limiter panel 111*b* can be pivotally attached to the upper horizontal arm right sidewall 106*b* such that a second end of the right upper limiter panel 111*b* can be rotatably positioned to cover at least a portion of the upper portion of the right limiter slot 110*b*. Similarly, a first end of the right lower limiter panel 112*b* can be pivotally attached to the upper horizontal arm right sidewall 106*b* such that a second end of the right lower limiter panel 112*b* can be rotatably positioned to cover at least a portion of the lower portion of the right limiter slot 110*b*.

The upper roller mount 88 can include an upper roller mount left sidewall 114*a*, an upper roller mount right sidewall 114*b*, an upper roller mount back wall 116, an upper roller mount top wall 118, one or more upper roller mount support struts 120, one or more bearing blocks 122, and one or more tension mounts 123. More specifically, the upper roller mount left sidewall 114*a* is aligned with the upper roller mount right sidewall 114*b* with the one or more upper roller mount support struts 120 therebetween. The upper roller mount front wall 116 can be attached at front edges of the upper roller mount left sidewall 114*a* and upper roller mount right sidewall 114*b*. The upper roller mount top wall 118 can be attached to the upper roller mount front wall 116, the top edge of the upper roller mount left sidewall 114*a*, and/or the top edge the upper roller mount right sidewall 114*b*. The one or more upper roller mount support struts 120 can be positioned between the upper roller mount left sidewall 114*a* and the upper roller mount right sidewall 114*b*, such as at an upper portion thereof (e.g., at the rearward end thereof). The one or more upper roller mount support struts 120 provide structural stability for the upper roller mount 88.

A left bearing block 122*a* can be positioned in a middle portion of the upper roller mount left sidewall 114*a* and a right bearing block 122*b* can be positioned in a middle portion of the upper roller mount right sidewall 114*b*. The one or more tension mounts 123 can be positioned above each of the one or more bearing blocks 122. More specifically, a left tension mount 123*a* is attached (e.g., via one or more bolts) to an upper edge of the upper roller mount left sidewall 114*a* and a right tension mount 123*b* is attached (e.g., via one or more bolts) to an upper edge of the upper roller mount rights sidewall 114*b*. The left tension mount 123*a* is also attached to the left bearing block 122*a* (e.g., via one or more bolts), such that the adjustable attachment (e.g., bolt) is in compression (the degree of which can be adjustable). The right tension mount 123*b* is also attached to the right bearing block 122*b* (e.g., via one or more bolts), such that the adjustable attachment (e.g., bolt) is in compression (the degree of which can be adjustable).

The upper roller mount 88 can be rotatably mounted to the upper horizontal arm 86 using one or more mounting components (e.g., tensioner, bearing block, bearing, nuts, bolts, screws, and the like). The upper roller mount 88 can include a left limiter bolt 115*a* fixedly attached to the upper roller mount left sidewall 114*a* and contained within and protruding out of the left limiter slot 106*a*. The upper roller mount 88 can include a right limiter bolt 115*b* fixedly attached to the upper roller mount right sidewall 114*b* and contained within and protruding out of the right limiter slot 106*b*. As a result, rotation of the upper roller mount 88 relative to the upper horizontal arm 86 can be controlled (e.g., limited) by motion of the left limiter bolt 115*a* within the left limiter slot 110*a* and motion of the right limiter bolt 115*b* within the right limiter slot 110*b*. Further, the position of the left upper limiter panel 111*a*, left lower limiter panel 112*a*, right upper limiter panel 111*b*, and/or right lower limiter panel 112*b* can be adjusted to control the degree of rotation of the upper roller mount 88 relative to the upper horizontal arm 86.

The upper driver roller 90 (e.g., upper input roller) can include an upper driver roller axle 124, an upper driver roller covering 126 positioned about the upper driver roller axle 124, an upper driver roller sprocket 128 positioned about and fixedly attached (e.g., by a set screw and/or collar) to the upper driver roller axle 124, and upper driver roller mounting components 130. The upper driver roller covering 126 does not cover the entire length of the upper driver roller axle 124, and more specifically, the upper driver roller covering 126 does not cover the portion of the upper driver roller axle 124 where the upper driver roller sprocket 128 is attached. The upper driver roller sprocket 128 can be fixedly attached towards a right side of the upper driver roller axle 124.

A left end (e.g., a first end) of the upper driver roller 90 can be rotatably mounted (by upper driver roller mounting components 130) to the left bearing block 122*a* in the middle portion of the upper roller mount left sidewall 114*a* and a right end (e.g., a second end) of the upper driver roller 90 can be rotatably mounted (e.g., by upper driver roller mounting components 130) to the right bearing block 122*b* in the middle portion of the upper roller mount right sidewall 114*b*. Accordingly, the upper driver roller 90 is biased downwardly relative to the upper roller mount 88 due to the bearing blocks 122 and tension mounts 123. The upper driver roller mounting components 130 can include ball bearings, nuts, washers, screws, and the like.

The first upper driven roller 92 (e.g., first upper output roller) can include a first upper driven roller axle 132, an upper driven roller covering 134 positioned about the upper driven roller axle 132, and first upper driver roller mounting components 136. The upper driver roller covering 134 can cover substantially the entire length of the first upper driven roller axle 132. A left end (e.g., a first end) of the first upper driven roller 92 can be rotatably mounted (by upper driven roller mounting components 136) to a lower front portion of the upper roller mount left sidewall 114*a* and a right end (e.g., a second end) of the first upper driven roller 92 can be rotatably mounted (by upper driven roller mounting components 136) to a lower front portion of the upper roller mount right sidewall 114*b*. The upper driven roller mounting components 136 can include ball bearings, nuts, washers, screws, and the like.

The second upper driven roller 94 (e.g., second upper output roller) can include a second upper driven roller axle 138, an upper driven roller covering 140 positioned about the upper driven roller axle 138, and second upper driven roller mounting components 142. The upper driver roller covering 134 can cover substantially the entire length of the second upper driven roller axle 132. A left end (e.g., a first end) of the second upper driven roller 94 can be rotatably mounted (by upper driven roller mounting components 142) to a lower rear portion of the upper roller mount left sidewall 114*a* and a right end (e.g., a second end) of the second upper driven roller 94 can be rotatably mounted (by upper driven roller mounting components 136) to a lower rear portion of the upper roller mount right sidewall 114*b*. The upper driven roller mounting components 142 can include ball bearings, nuts, washers, screws, and the like.

Accordingly, as shown in FIG. 6, for example, the upper driver roller 90 is positioned above and in between the first upper driven roller 92 and the second upper driven roller 94. Further, because the upper driver roller 90 is biased downwardly relative to the upper roller mount 88, the upper driver roller 90 is biased to make and maintain contact with at least one of the first upper driven roller 92 and the second upper driven roller 94. As a result, rotation of the upper driver roller 90 drives rotation of both the first upper driven roller 92 and the second upper driven roller 94 at a speed the same as, but in a direction opposite to that of, the upper driver roller 90.

As shown in FIG. 5, for example, the upper roller subassembly 14 is narrower than the lower roller subassembly 12. More specifically, the first upper driven roller 92 and the second upper driven roller 94 of the upper roller subassembly 14 are narrower than the first lower driven roller 30, the second lower driven roller 32, and/or the lower support roller 34 of the lower roller subassembly 12. This is designed to provide sufficient space for the left sandwich guard and right sandwich guard described below.

The upper roller drive motor 96 can be mounted to the upper roller mount top wall 118 and includes an upper roller drive motor sprocket 144 which provides rotational output of the upper roller drive motor 96. The upper roller drive motor sprocket 144 is aligned with the upper driver roller sprocket 128. The upper roller drive chain 98 mechanically connects the upper driver roller sprocket 128 and the upper roller drive motor sprocket 144. The sizes of one or more of the upper driver roller sprocket 128 and the upper roller drive motor sprocket 144 can be varied to alter the performance of the gear train (e.g., the speed ratio, mechanical advantage, and the like).

Accordingly, mechanical power is transferred through the gear train from the upper roller drive motor 96 to the upper roller drive motor sprocket 144 to the upper roller drive chain 98 to the upper driver roller sprocket 128 to the first upper driver roller 90 to both the first upper driven roller 92 and the second upper driven roller 94. Thereby, the upper roller drive motor 96 provides rotational power and energy to the first upper driven roller 92 and second upper driven roller 94 via the lower driver roller 28. The resulting speed of the upper driver roller 90 being dependent upon the power output of the upper roller drive motor 96 and the gear train characteristics (e.g., sizes of sprockets, sizes of rollers, and the like).

The upper roller subassembly 14 pivots from an open position (e.g., as shown in FIGS. 3-6) where the upper roller mount 114*a* (and associated upper driver roller 90, first upper driven roller 92, and second upper driven roller 94) is pivoted away from the top portion of the lower roller subassembly 12 (and associated the lower driver roller 28, first lower driven roller 30, second lower driven roller 32, and lower support roller 34) to a closed position where the upper roller mount 114*a* is pivoted towards the top portion of the lower roller subassembly 12. In the closed position the first upper driven roller 92, second upper driven roller 94, first lower driven roller 30, second lower driven roller 32, and lower support roller 34 form a generally circular shape to rotate and wrap a sandwich placed therein.

The multiple drive motors and rollers facilitate even pressure on wrapping the sandwich. The lower roller drive motor 36 and upper roller drive motor 96 can be synchronized in the sense that the first lower driven roller 30, second lower driven roller 32, first upper driven roller 92, and second upper driven roller 94 are all providing the same surface speed on the sandwich. Although multiple drive motors and rollers are disclosed herein, the automated sandwich wrapping system 10 can use more or fewer drive motors and/or rollers. For example, the automated sandwich wrapping system 10 can utilize only the first upper driven roller 92, second upper driven roller 94, the lower driver roller 28, first lower driven roller 30, lower support roller 34, and lower roller drive motor 36 (thereby omitting the second lower driven roller 32, the upper driver roller 90, and upper roller drive motor 96).

Figure 7:
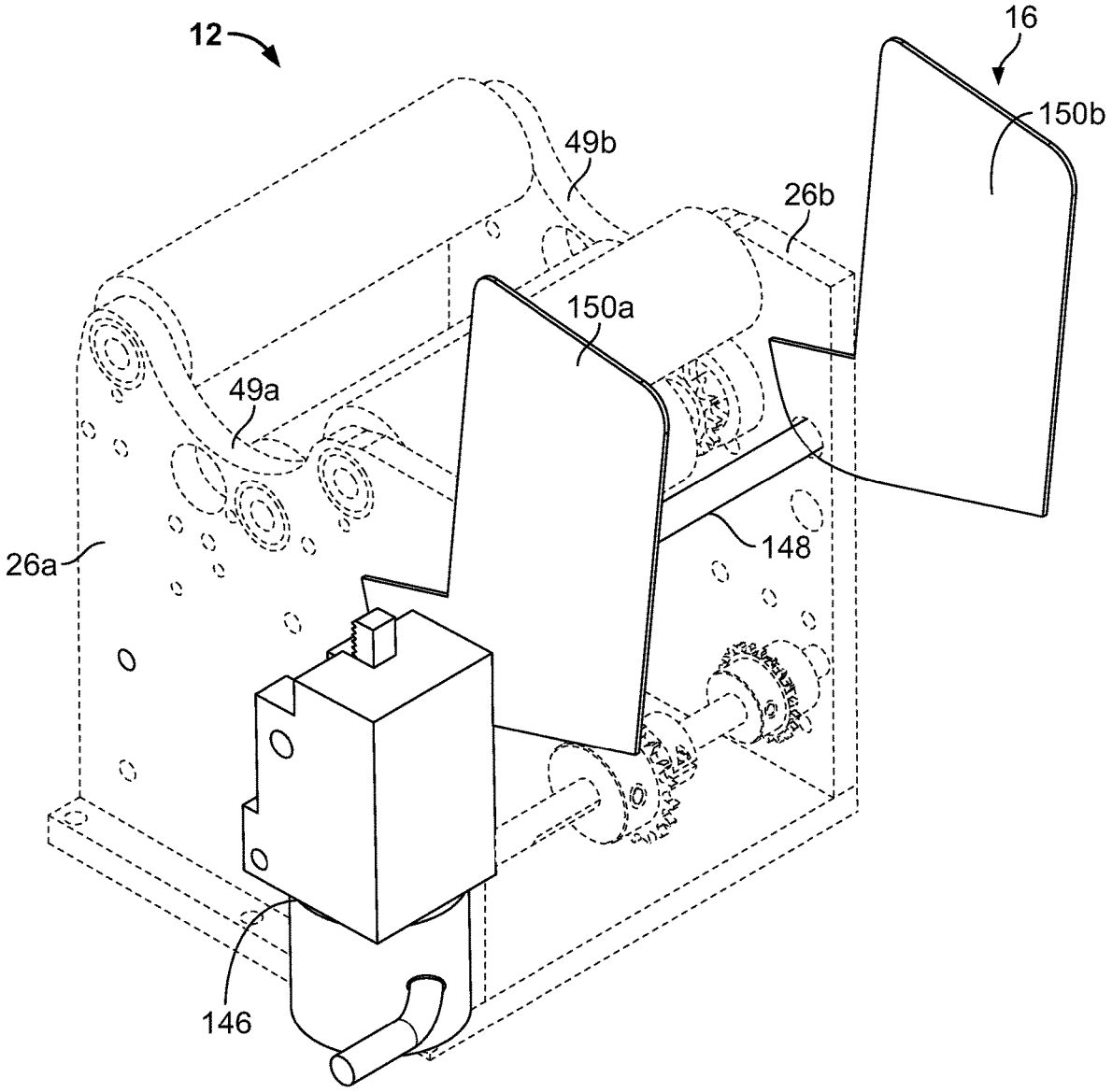
FIG. 7 is a front perspective view of an embodiment of the creasing blade subassembly of the automated sandwich wrapping system of FIG. 1, additional components shown in dashed lines for the purpose of drawing clarity of the creasing blade subassembly.
Figure 8:
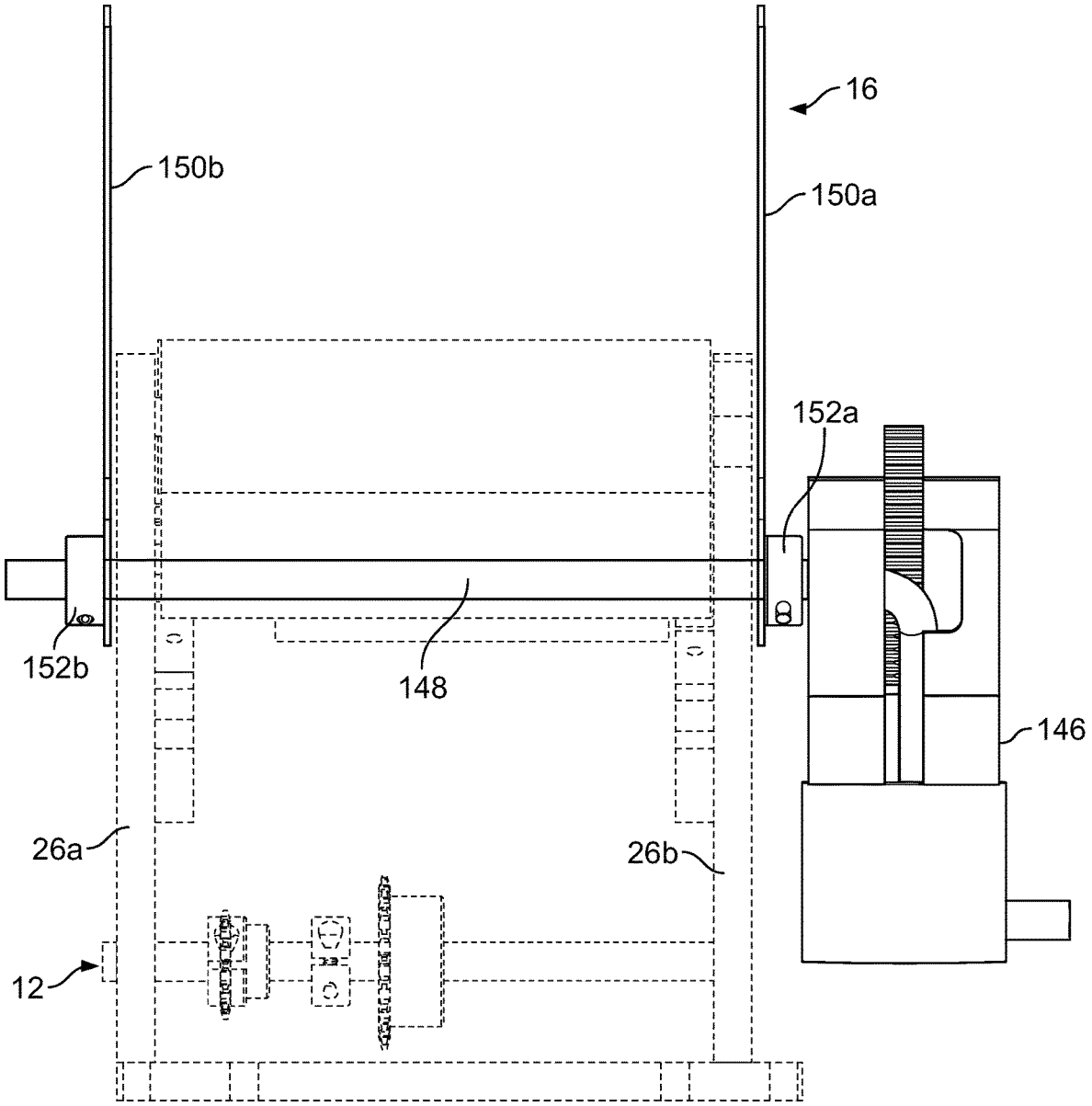
FIG. 8 is a rear elevational view of an embodiment of the creasing blade subassembly of FIGS. 1 and 7.
Figure 9:
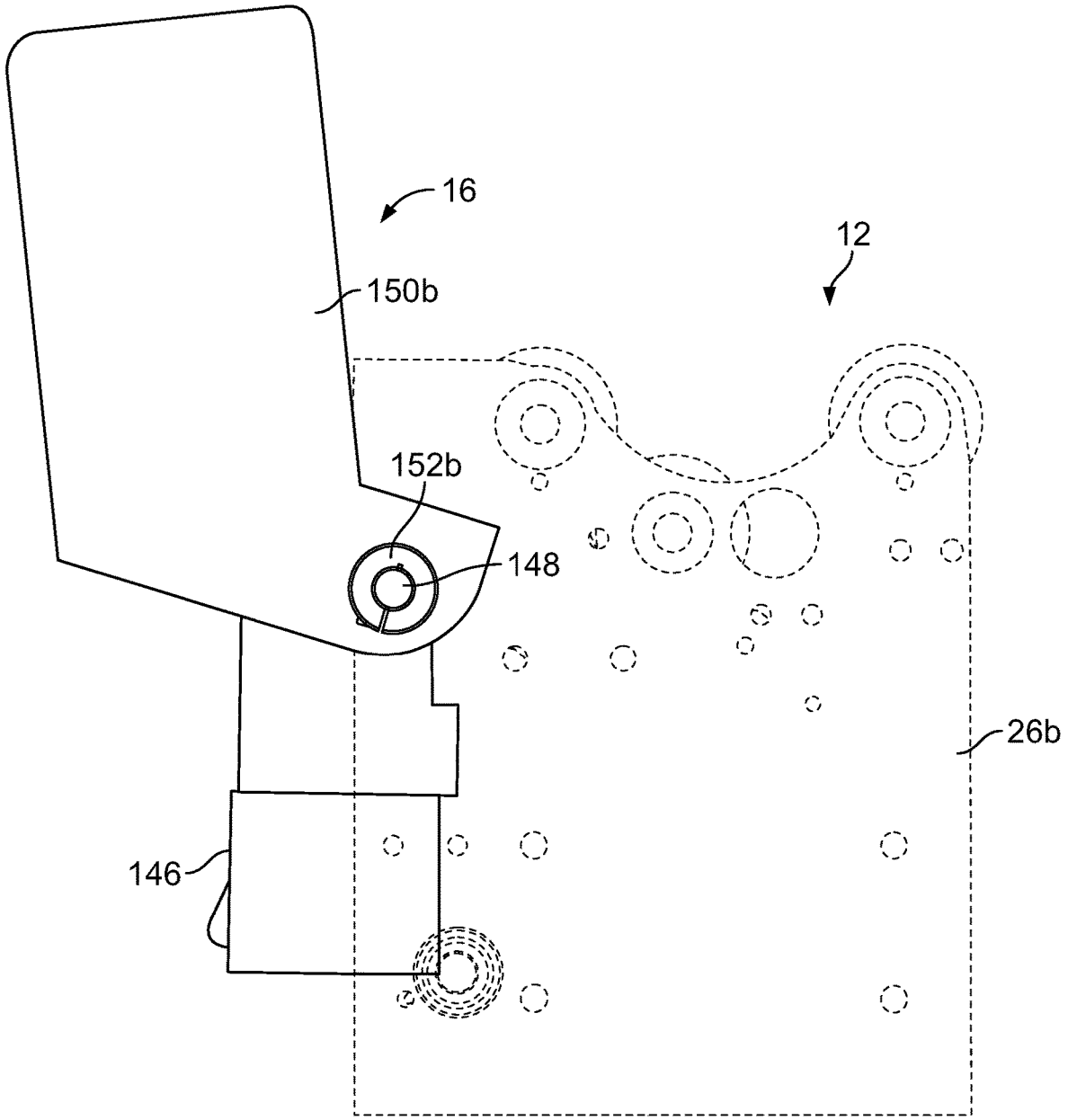
FIG. 9 is a side elevational view of an embodiment of the creasing blade subassembly of FIGS. 1 and 7-8.

FIGS. 7-9 are view of the creasing blade subassembly of the automated sandwich wrapping system. More specifically, FIG. 7 is a front perspective view of an embodiment of the creasing blade subassembly of the automated sandwich wrapping system of FIG. 1, additional components shown in dashed lines for the purpose of drawing clarity of the creasing blade subassembly, FIG. 8 is a rear elevational view of an embodiment of the creasing blade subassembly of FIGS. 1 and 7, and FIG. 9 is a side elevational view of an embodiment of the creasing blade subassembly of FIGS. 1 and 7-8. The creasing blade subassembly 16 creases the sandwich wrapping paper extending past ends of the sandwich to make it easier to fold the sandwich wrapping paper, which facilitates tight wrapping of the sandwich.

The creasing blade subassembly 16 includes a creasing blade drive motor 146, a creasing blade axle 148, a left creasing blade 150*a*, right creasing blade 150*b*, left creasing blade mounting components 152*a*, and right creasing blade mounting components 152*b*. More specifically, the creasing blade drive motor 146 is in direct mechanical communication with the creasing blade axle 148. The creasing blade drive motor 146 can be a gear rack motor, a stepper motor, or any other suitable type of motor.

The creasing blade axle 148 is rotatably mounted to lower roller subassembly 12. More specifically, a first end of the creasing blade axle 148 is rotatably mounted to and extends through the base left sidewall 26*a* and a second end of the creasing blade axle 148 is rotatably mounted to and extends through the base right sidewall 26*b*. Left creasing blade 150*a* is fixedly attached (by left creasing blade mounting components 152*a*) approximately at first end of the creasing blade axle 148 adjacent to the outside surface of the base left sidewall 26*a*) and right creasing blade 150*b* is fixedly attached (by right creasing blade mounting components 152*b*) approximately at second end of the creasing blade axle 148 adjacent to the outside surface of the base right sidewall 26*b*). The left creasing blade mounting components 152*a* and the right creasing blade mounting components 152*b* can include collars, nuts, washers, screws, and the like.

Accordingly, when the creasing blade drive motor 146 rotates the creasing blade axle 148 both the left creasing blade 150*a* and the right creasing blade 150*b* rotate together with the creasing blade axle 148. The left creasing blade 150 and right creasing blade 150*b* rotate from a front vertical position (as shown in FIGS. 7-9) to a rear horizontal position in which at least a portion of the left creasing blade 150*a* rotates past the left arc 49*a* of the base left sidewall 26*a* and in which at least a portion of the right creasing blade 150*b* rotates past the right arc 49*b* of the base right sidewall 26*b*.

Figure 10:
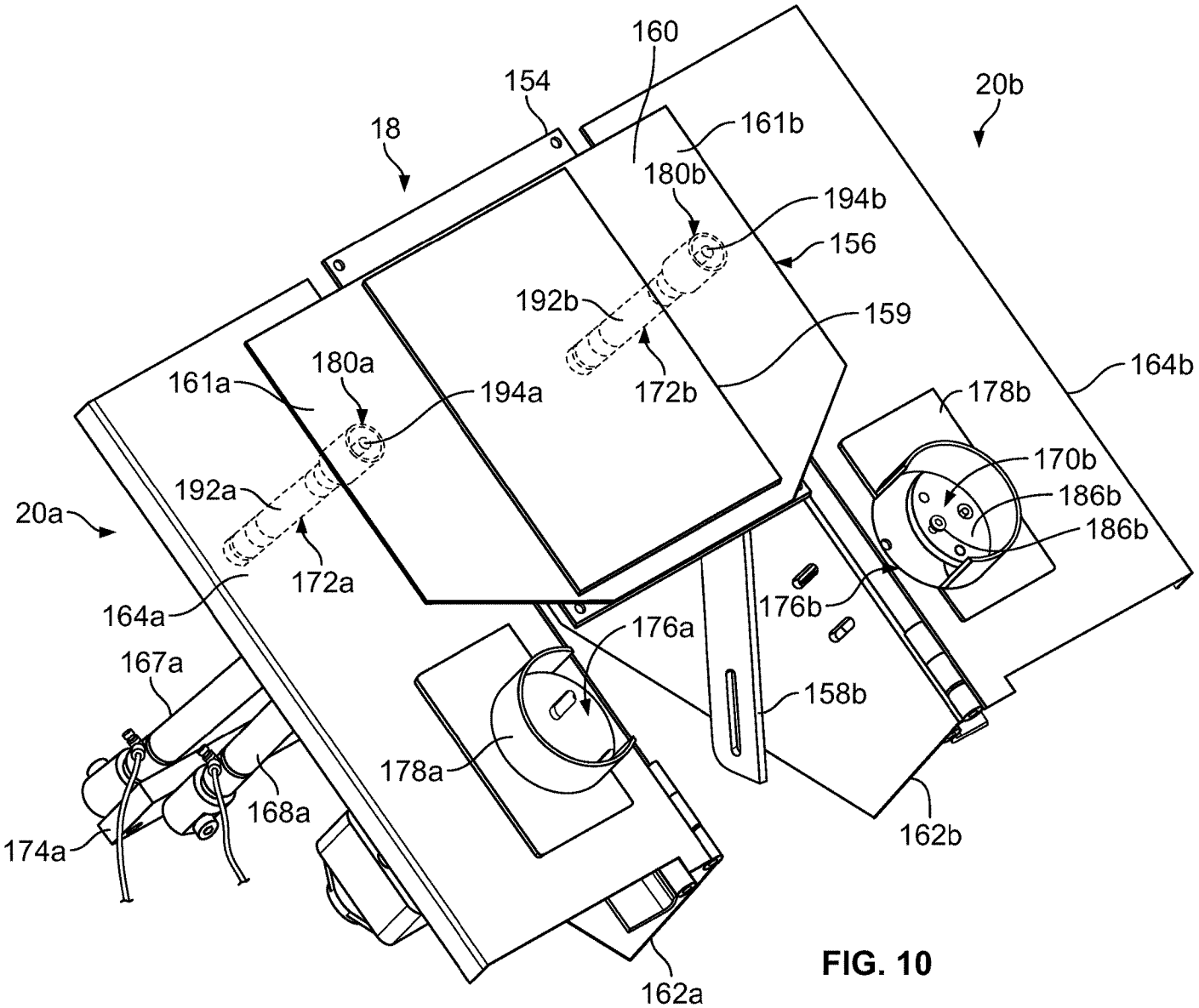
FIG. 10 is a front perspective view of an embodiment of the sandwich wrapping paper support subassembly, the left folding subassembly, and the right folding subassembly of the automated sandwich wrapping system of FIG. 1.
Figure 11:
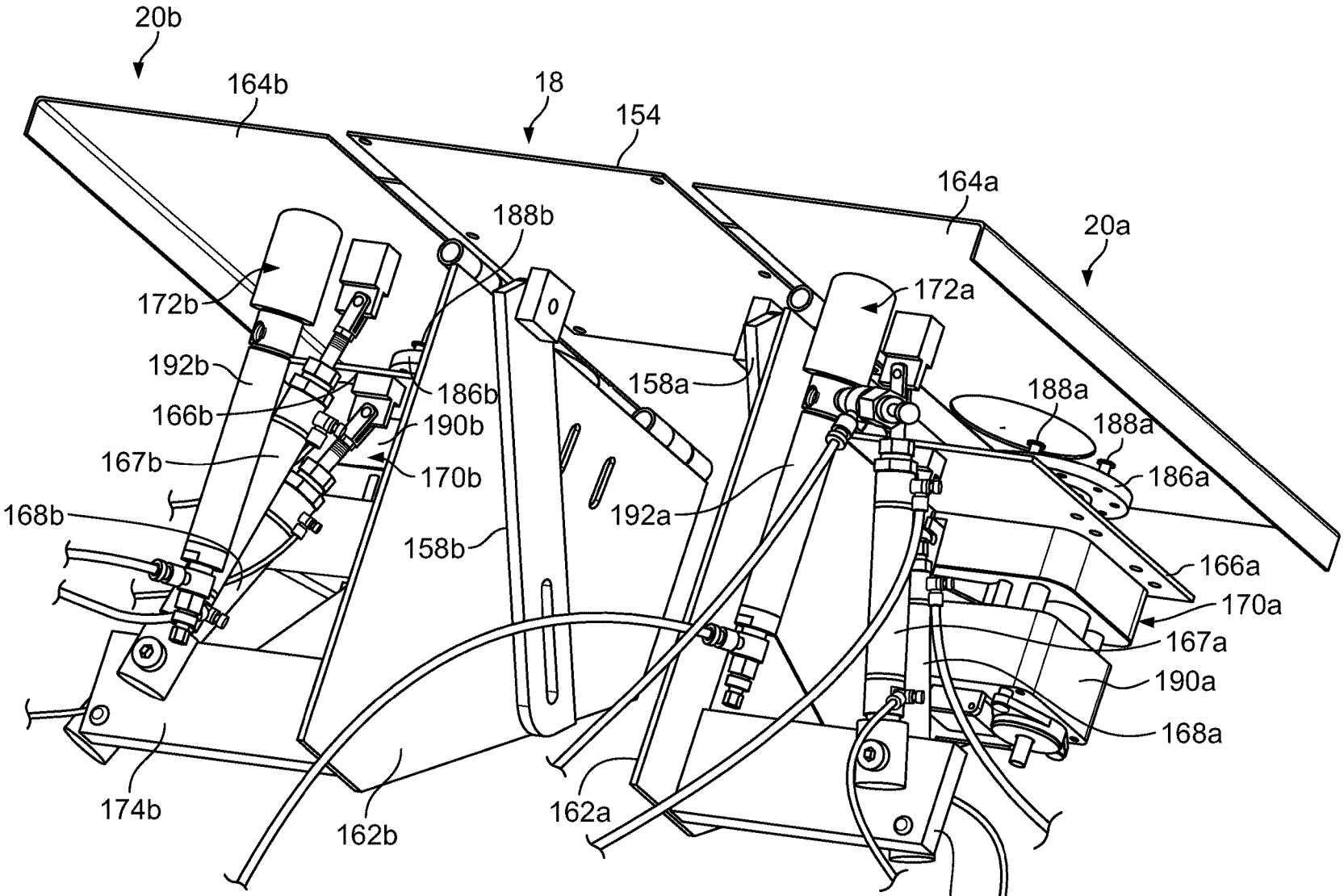
FIG. 11 is a rear perspective view of an embodiment of the sandwich wrapping paper support subassembly, the left folding subassembly, and the right folding subassembly of FIGS. 1 and 10.
Figure 12:
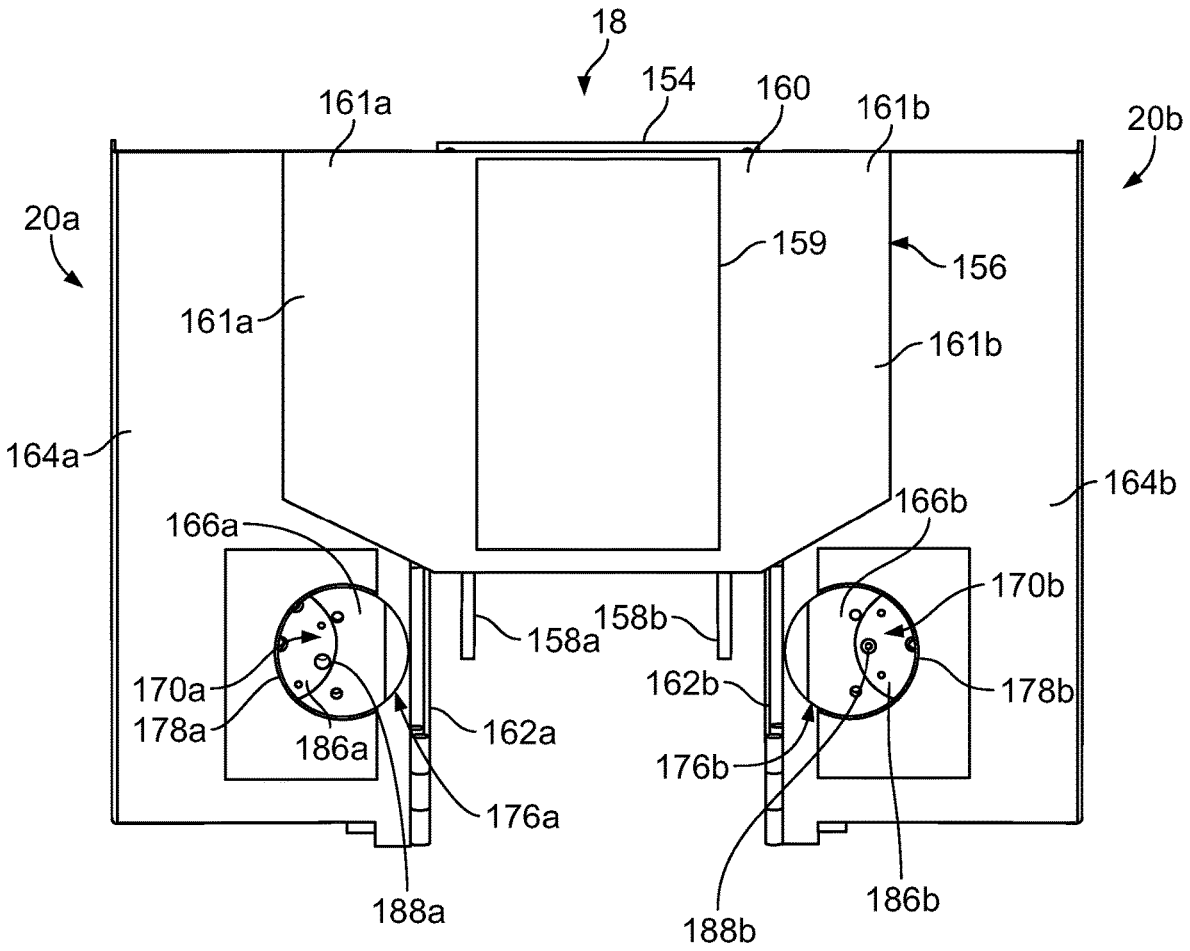
FIG. 12 is a top plan view of an embodiment of the sandwich wrapping paper support subassembly, the left folding subassembly, and the right folding subassembly of FIGS. 1 and 10-11.

FIGS. 10-14 are views of the sandwich wrapping paper support subassembly, the left folding subassembly, and the right folding subassembly of the automated sandwich wrapping system. More specifically, FIG. 10 is a front perspective view of an embodiment of the sandwich wrapping paper support subassembly, the left folding subassembly, and the right folding subassembly of the automated sandwich wrapping system of FIG. 1, FIG. 11 is a rear perspective view of an embodiment of the sandwich wrapping paper support subassembly, the left folding subassembly, and the right folding subassembly of FIGS. 1 and 10, FIG. 12 is a top plan view of an embodiment of the sandwich wrapping paper support subassembly, the left folding subassembly, and the right folding subassembly of FIGS. 1 and 10-11, FIG. 13 is a bottom plan view of an embodiment of the sandwich wrapping paper support subassembly, the left folding subassembly, and the right folding subassembly of FIGS. 1 and 10-12, and FIG. 14 is a front perspective view of an embodiment of the sandwich wrapping paper support subassembly, the left folding subassembly, and the right folding subassembly of FIGS. 1 and 10-14 when assembled with the lower roller subassembly, the upper roller subassembly, and the creasing blade subassembly.

The sandwich wrapping paper support assembly 18 supports and secures sandwich wrapping paper to facilitate proper feeding of the sandwich wrapping paper to ensure proper wrapping of the sandwich. The sandwich wrapping paper support assembly 18 also folds portions of the sandwich wrapping paper to facilitate wrapping of the sandwich. The sandwich wrapping paper support assembly 18 is positioned in between a left folding subassembly 20*a* and a right folding subassembly 20*b*. The sandwich wrapping paper support subassembly 18 includes a sandwich wrapping paper feeder plate 154, a folding panel 156, a left sandwich wrapping paper feeder plate mount 158*a*, a right sandwich wrapping paper feeder plate mount 158*b*, a sandwich wrapping paper stabilizing clip 159.

Figure 13:
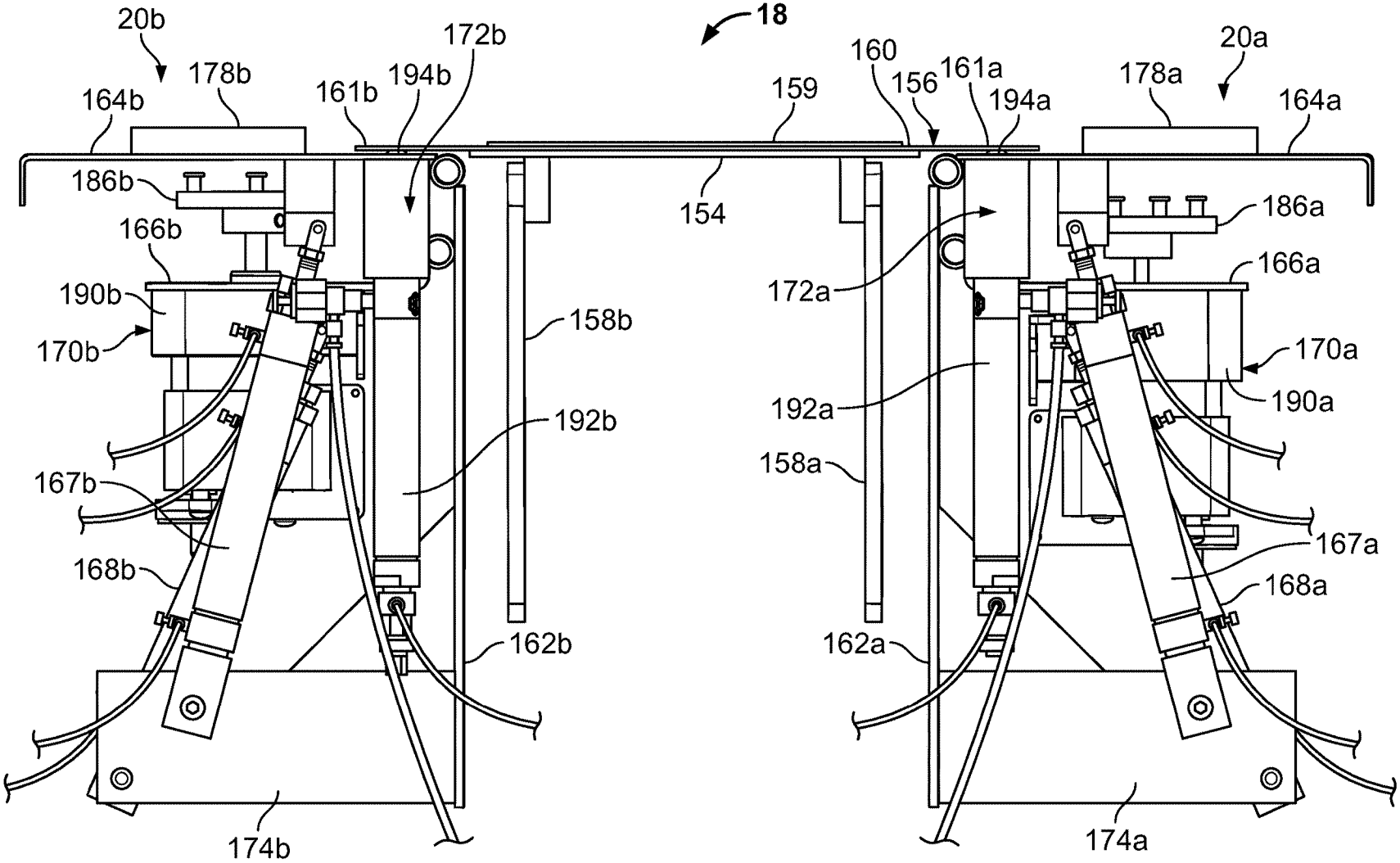
FIG. 13 is a bottom/front perspective view of an embodiment of the sandwich wrapping paper support subassembly, the left folding subassembly, and the right folding subassembly of FIGS. 1 and 10-12.

As shown in FIGS. 11 and 13, for example, a first end of the left sandwich wrapping paper feeder plate mount 158*a* is pivotably attached at a bottom surface approximately at a left side of the sandwich wrapping paper feeder plate 154. A second end of the left sandwich wrapping paper feeder plate mount 158*a* is pivotally and/or slidably attached to a left sidewall 162*a* of the left folding subassembly 20*a* (discussed below). A first end of the right sandwich wrapping paper feeder plate mount 158*b* is pivotably attached at a bottom surface approximately at a right side of the sandwich wrapping paper feeder plate 154. A second end of the right sandwich wrapping paper feeder plate mount 158*b* is pivotally and/or slidably attached to a right sidewall 162*b* of the right folding subassembly 20*b* (discussed below). The left sandwich wrapping paper feeder plate mount 158*a* and the right sandwich wrapping paper feeder plate mount 158*b* allow the sandwich wrapping paper feeder plate 154 to be oriented at a variety of angles and/or heights.

Figure 14:
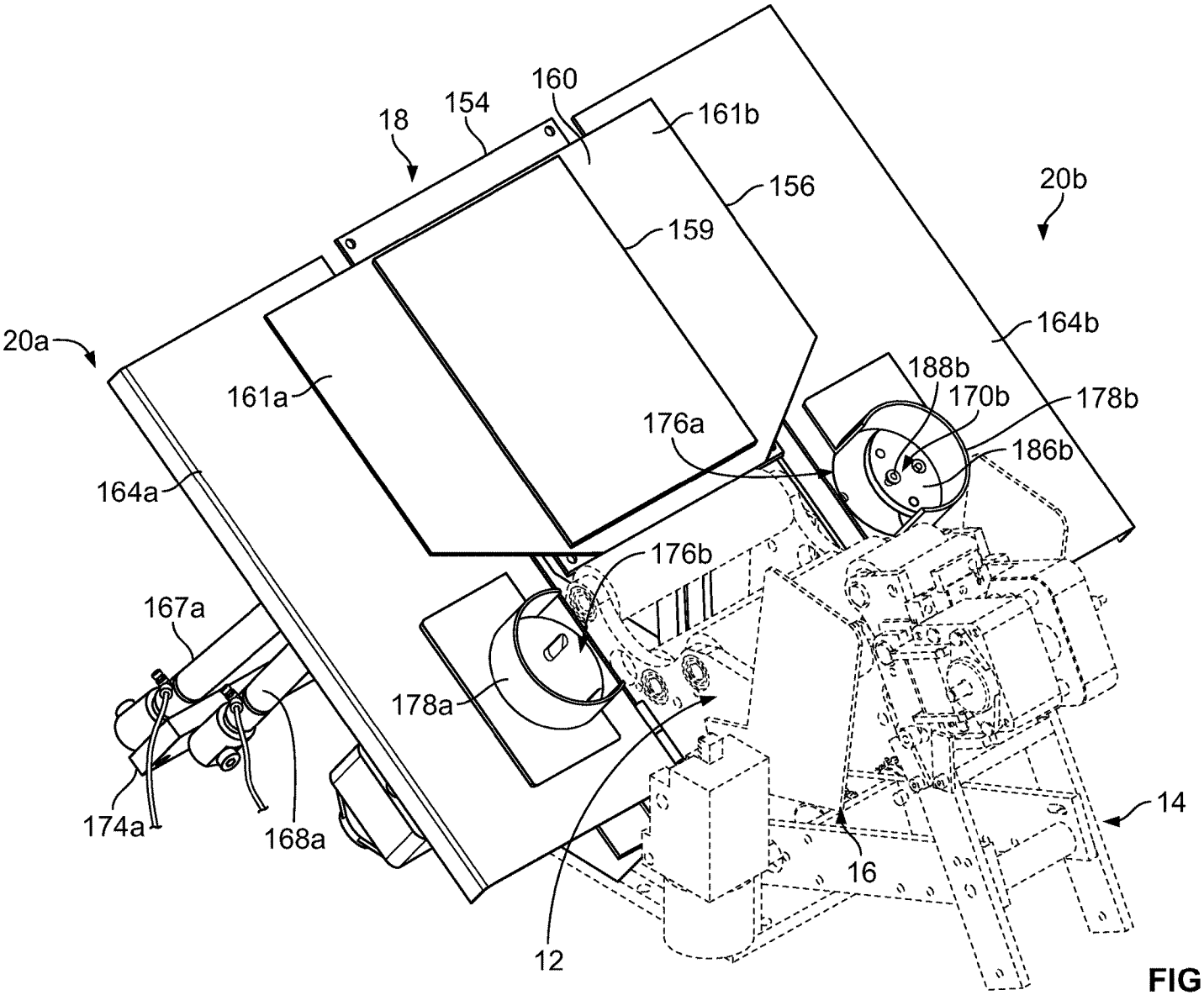
FIG. 14 is a front perspective view of an embodiment of the sandwich wrapping paper support subassembly, the left folding subassembly, and the right folding subassembly of FIGS. 1 and 10-14 when assembled with the lower roller subassembly, the upper roller subassembly, and the creasing blade subassembly.

As shown in FIGS. 10, 12, and 14, for example, the folding panel 156 includes a body portion 160, a left folding flap 161*a*, and a right folding flap 161*b*. The bottom edge of the left folding flap 161*a* and the bottom edge of the right folding flap 161*b* can be tapered. The left folding flap 161*a* extends past the left edge of the sandwich wrapping paper feeder plate 154 such that the left folding flap 161*a* is foldable at approximately the left edge of the sandwich wrapping paper feeder plate 154. The right folding flap 161*b* extends past the right edge of the sandwich wrapping paper feeder plate 154 such that the right folding flap 161*b* is foldable at approximately the right edge of the sandwich wrapping paper feeder plate 154. As described in more detail below, the left folding flap 161*a* and the right folding flap 161*b* can pivotally move into one or more positions or positions (described below).

The sandwich wrapping paper stabilizing clip 159 is mounted approximately at a rear edge of the sandwich wrapping paper feeder plate 154, and is mounted on top of the folding panel 156 such that the folding panel 156 is positioned between the sandwich wrapping paper feeder plate 154 and the sandwich wrapping paper stabilizing clip 159. The sandwich wrapping paper stabilizing clip 159 can be attached to the sandwich wrapping paper feeder plate 154 and/or the folding panel 156 using mounting components (e.g., clamps, nuts, bolts, screws, and the like).

The left folding subassembly 20*a* includes a left sidewall 162*a*, a left upper folding plate 164*a*, a left lower folding plate 166*a*, a left upper folding plate piston 167*a*, a left lower folding plate piston 168*a*, a left gripper 170*a*, and a left plunger 172*a*. More specifically, the left sidewall 162*a* includes a left support brace 174*a* extending outwardly from a left surface at approximately a bottom edge of the left sidewall 162*a* (e.g., away from the sandwich wrapping paper support subassembly 18). The left support brace 174*a* provides, among other things, stability for the left folding subassembly 20*a*.

As shown in FIGS. 11 and 13, for example, the left upper folding plate 164*a* and right upper folding plate 164*b* hingedly move between an idle position to an active position to fold ends of the sandwich wrapping paper that extend past the sandwich. The left lower folding plate 166*a* and the right lower folding plate 166*b* hingedly move between an idle position and an active position to align and contact left gripper 170*a* and right gripper 170*b* with ends of the sandwich. Once left gripper 170*a* and right gripper 170*b* engage ends of the sandwich, left gripper 170*a* and right gripper 170*b* rotate to facilitate wrapping of the sandwich in the sandwich wrapping paper.

As shown in FIGS. 11 and 13, for example, the left sidewall 162*a* includes a left upper folding plate 164*a* hingedly attached at an angled upper edge of the left sidewall 162*a*. As a result, the left upper folding plate 164*a* is angled with respect to the bottom edge of the left sidewall 162*a* (and the ground as well). The sandwich wrapping paper feeder plate 154 can be oriented and adjusted such that the sandwich wrapping paper feeder plate 154 and the left upper folding plate 164*a* are in the same plane. The left upper folding plate 164*a* includes a left gripper opening 176*a* defined therein, and a left sandwich guard 178*a*, and a left plunger opening 180*a*. The left sandwich guard 178*a* extends upwardly about at least a portion of the perimeter of the left gripper opening 176*a*. For example, there can be a gap in the left sandwich guard 178*a* at the portion closest to the sandwich wrapping paper feeder plate 154. The left gripper opening 176*a* is more forwardly positioned than the left plunger opening 180*a* (e.g., the left plunger opening 180*a* is above the left gripper opening 176*a*).

The left lower folding plate 166*a* is hingedly attached to the left sidewall 162*a* and positioned beneath the left upper folding plate 164*a*. The left lower folding plate 166*a* can be smaller than the left upper folding plate 164*a*.

A first end of the left upper folding plate piston 167*a* is pivotally attached to the left support brace 174*a*. A second end of the left upper folding plate piston 167*a* is pivotally attached to the lower surface of the left upper folding plate 164*a*. Accordingly, extension and retraction of the left upper folding plate piston 167*a* controls the position of the left upper folding plate 164*a*. More specifically, when the left upper folding plate piston 167*a* is retracted, the left upper folding plate 164*a* is in an idle position, where the left upper folding plate 164*a* is approximately parallel and coplanar with the sandwich wrapping paper feeder plate 154 (e.g., as shown in FIGS. 10-14). When the left upper folding plate piston 167*a* extends, the left upper folding plate 164*a* moves to an active position, where the left upper folding plate 164*a* is approximately perpendicular to the sandwich wrapping paper feeder plate 154.

A first end of the left lower folding plate piston 168*a* is pivotally attached to the left support brace 174*a*. A second end of the left lower folding plate piston 168*a* is pivotally attached to the lower surface of the left lower folding plate 166*a*. Accordingly, extension and retraction of the left lower folding plate piston 168*a* controls the position of the left lower folding plate 166*a*. More specifically, when the left lower folding plate piston 168*a* is retracted, the left lower folding plate 166*a* is in a idle position, where the left lower folding plate 166*a* is approximately parallel with the sandwich wrapping paper feeder plate 154 (e.g., as shown in FIGS. 10-14). When the left lower folding plate piston 168*a* extends, the left upper folding plate 166*a* moves to a active position, where the left lower folding plate 166*a* is approximately perpendicular to the sandwich wrapping paper feeder plate 154.

The left gripper 170*a* is mounted to the left lower folding plate 166*a*. The left gripper 170*a* includes a left rotatable gripper plate 186*a*, a plurality of left gripping fingers 188*a* extending from the left rotatable gripper plate 186*a*, and a left gripper motor 190*a* mechanically connected to the left rotatable gripper plate 186*a*. The left gripper plate 186*a* can be circular and the plurality of left gripping fingers 188*a* can be evenly positioned about the perimeter of the gripper plate 186*a*. The left gripper motor 190*a* can control the rotational direction and/or speed of the rotation of the left rotatable gripper plate 186*a*.

As shown in FIG. 12, for example, when the left upper folding plate 164*a* is in the idle position and the left lower folding plate 166*a* is in the idle position, the central axis of the left gripper 170*a* is offset to the left of the central axis of the left gripper opening 176*a*. This way, when the left upper folding plate 164*a* is in the active position and the left lower folding plate 166*a* is in the active position, the central axis of the left gripper 170*a* will substantially align with the central axis of the left gripper opening 176*a*.

As shown in FIG. 13, for example, the left plunger 172*a* is mounted to the left upper folding plate 164*a* at the left plunger opening 180*a*. The left plunger 172*a* includes a left pneumatic cylinder 192*a* and a left extendable plunger arm 194*a* in mechanical connection therewith. The left extendable plunger arm 194*a* is extendable (and retractable) and idly rotatable (i.e., rotatably driven).

As shown in FIGS. 11 and 13, for example, the right folding subassembly 20*b* includes a right sidewall 162*b*, a right upper folding plate 164*b*, a right lower folding plate 166*b*, a right upper folding plate piston 167*b*, a right lower folding plate piston 168*b*, a right gripper 170*b*, and a right plunger 172*b*. More specifically, the right sidewall 162*b* includes a right support brace 174*b* extending outwardly from a right surface at approximately a bottom edge of the right sidewall 162*b* (e.g., away from the sandwich wrapping paper support subassembly 18). The right support brace 174*b* provides, among other things, stability for the right folding subassembly 20*b*.

The right sidewall 162*b* includes a right upper folding plate 164*b* hingedly attached at an angled upper edge of the right sidewall 162*b*. As a result, the right upper folding plate 164*b* is angled with respect to the bottom edge of the right sidewall 162*b* (and the ground as well). Further, the sandwich wrapping paper feeder plate 154 can be oriented and adjusted such that the sandwich wrapping paper feeder plate 154 and the right upper folding plate 164*b* are in the same plane. The right upper folding plate 164*b* includes a right gripper opening 176*b* defined therein, a right sandwich guard 178*b*, and a right plunger opening 180*b*. The right sandwich guard 178*b* extends upwardly about at least a portion of the perimeter of the right gripper opening 176*b*. For example, there can be a gap in the right sandwich guard 178*b* at the portion closest to the sandwich wrapping paper feeder plate 154. The right gripper opening 176*b* is more forwardly positioned than the right plunger opening 180*b* (e.g., the right plunger opening 180*b* is above the right gripper opening 176*b*).

The right lower folding plate 166*b* is hingedly attached to the right sidewall 162*b* and positioned beneath the right upper folding plate 164*b*. The right lower folding plate 166*b* can be smaller than the right upper folding plate 164*b*.

A first end of the right upper folding plate piston 167*b* is pivotally attached to the right support brace 174*b*. A second end of the right upper folding plate piston 167*b* is pivotally attached to the lower surface of the right upper folding plate 164*b*. Accordingly, extension and retraction of the right upper folding plate piston 167*b* controls the position of the right upper folding plate 164*b*. More specifically, when the right upper folding plate piston 167*b* is retracted, the right upper folding plate 164*b* is in an idle position, where the right upper folding plate 164*b* is approximately parallel and coplanar with the sandwich wrapping paper feeder plate 154 (e.g., as shown in FIGS. 10-14). When the right upper folding plate piston 167*b* extends, the right upper folding plate 164*b* moves to an active position, where the right upper folding plate 164*b* is approximately perpendicular to the sandwich wrapping paper feeder plate 154.

A first end of the right lower folding plate piston 168*b* is pivotally attached to the right support brace 174*b*. A second end of the right lower folding plate piston 168*b* is pivotally attached to the lower surface of the right lower folding plate 166*b*. Accordingly, extension and retraction of the right lower folding plate piston 168*b* controls the position of the right lower folding plate 166*b*. More specifically, when the right lower folding plate piston 168*b* is retracted, the right lower folding plate 166*b* is in an idle position, where the right lower folding plate 166*b* is approximately parallel with the sandwich wrapping paper feeder plate 154 (e.g., as shown in FIGS. 10-14). When the right lower folding plate piston 168*b* extends, the right upper folding plate 166*b* moves to an active position, where the right lower folding plate 166*b* is approximately perpendicular to the sandwich wrapping paper feeder plate 154.

The right gripper 170*b* is mounted to the right lower folding plate 166*b*. The right gripper 170*b* includes a right rotatable gripper plate 186*b*, a plurality of right gripping fingers 188*b* extending from the right rotatable gripper plate 186*b*, and a right gripper motor 190*b* mechanically connected to the right rotatable gripper plate 186*b*. The right gripper plate 186*b* can be circular and the plurality of right gripping fingers 188*b* can be evenly positioned about the perimeter of the gripper plate 186*b*. The right gripper motor 190*b* can control the rotational direction and/or speed of the rotation of the right rotatable gripper plate 186*b*.

As shown in FIG. 12, for example, when the right upper folding plate 164*b* is in the idle position and the right lower folding plate 166*b* is in the idle position, the central axis of the right gripper 170*b* is offset to the right of the central axis of the right gripper opening 176*b*. This way, when the right upper folding plate 164*b* is in the active position and the right lower folding plate 166*b* is in the active position, the central axis of the right gripper 170*b* will substantially align with the central axis of the right gripper opening 176*b*.

As shown in FIG. 13, for example, the right plunger 172*b* is mounted to the right upper folding plate 164*b* at the right plunger opening 180*b*. The right plunger 172*b* includes a right pneumatic cylinder 192*b* and a right extendable plunger arm 194*b* in mechanical connection therewith. The right extendable plunger arm 194*b* is extendable (and retractable) and idly rotatable (i.e., rotatably driven, does not rotatably drive).

Using the above mechanisms, the folding panel 156 is movable to a plurality of positions. More specifically, as shown in FIG. 10, when the left upper folding plate 164*a* is in the idle position and the left extendable plunger arm 194*a* is in the retracted position, the left folding flap 161*a* is in a coplanar position, where the left folding flap 161*a* is substantially coplanar with the folding panel body portion 160. When the left upper folding plate 164*a* is in the active position and the left extendable plunger arm 194*a* is in the retracted position, the left folding flap 161*a* is in a perpendicular position, where the left folding flap 161*a* is substantially perpendicular with the folding panel body portion 160. When the left upper folding plate 164*a* is in the active position and the left extendable plunger arm 194*a* is in the extended position, the left folding flap 161*a* is in a folded position, where the left folding flap 161*a* is substantially parallel, but not coplanar, with the folding panel body portion 160 as the left folding flap 161*a* is further folded inward by the left extendable plunger arm 194*a*.

Similarly, as shown in FIG. 10, when the right upper folding plate 164*b* is in the idle position and the right extendable plunger arm 194*b* is in the retracted position, the right folding flap 161*b* is in a coplanar position, where the right folding flap 161*b* is substantially coplanar with the folding panel body portion 160. When the right upper folding plate 164*b* is in the active position and the right extendable plunger arm 194*b* is in the retracted position, the right folding flap 161*b* is in a perpendicular position, where the right folding flap 161*b* is substantially perpendicular with the folding panel body portion 160. When the right upper folding plate 164*b* is in the active position and the right extendable plunger arm 194*b* is in the extended position, the right folding flap 161*b* is in a folded position, where the right folding flap 161*b* is substantially parallel, but not coplanar, with the folding panel body portion 160 as the right folding flap 161*b* is further folded inward by the right extendable plunger arm 194*b*.

When the left upper folding plate 164*a* and the right upper folding plate 164*b* are both in the active position, the left gripper opening 176*a* is coaxial with the right gripper opening 176*b*. Further, when the left upper folding plate 164*a* and the right upper folding plate 164*b* are in the active position, and the left lower folding plate 166*a* and the right lower folding plate 166*b* are in the active position, the left gripper opening 176*a*, the right gripper opening 176*b*, the left gripper 170*a*, and the right gripper 170*b* are all coaxial with one another.

Figure 15:
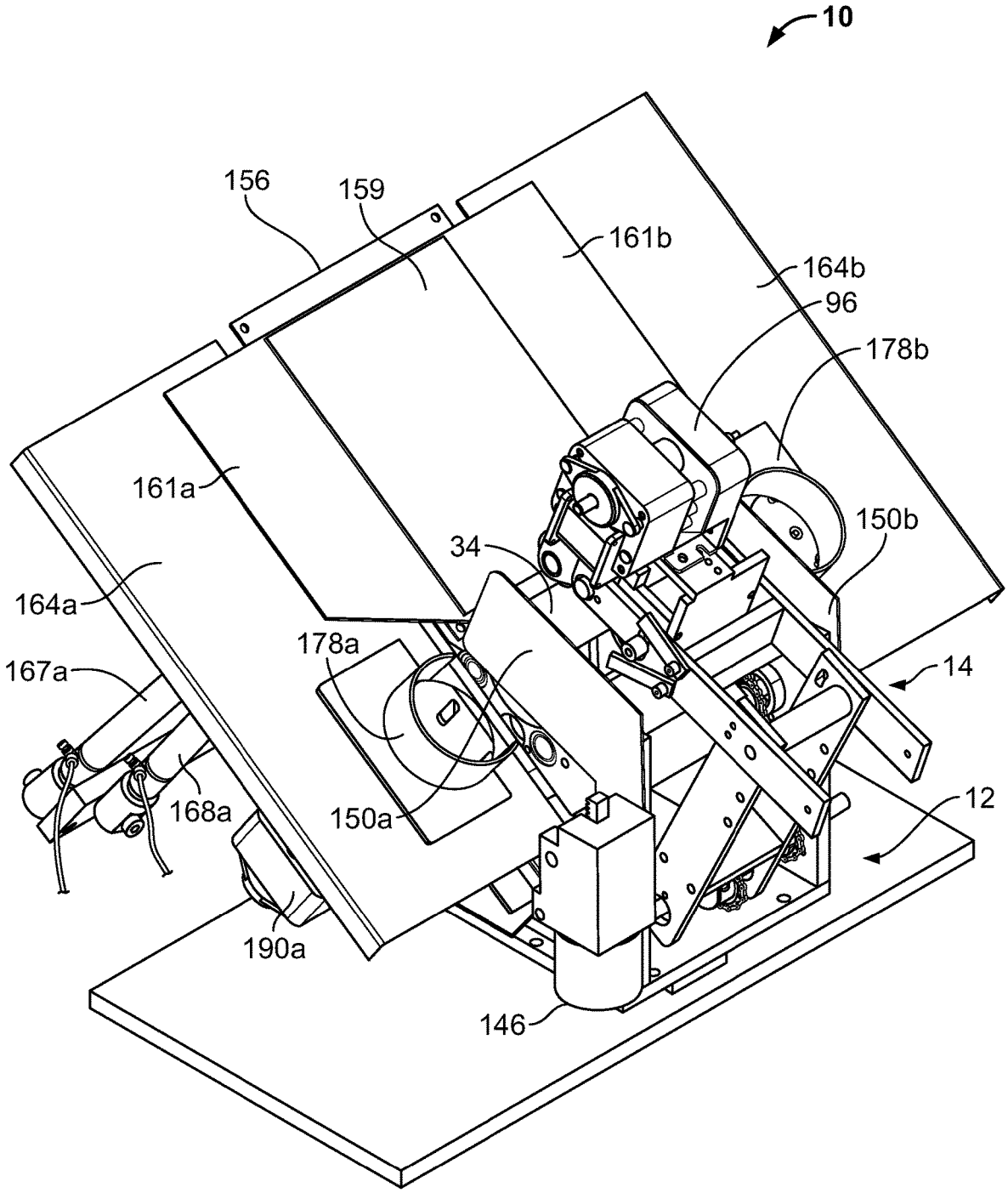
FIG. 15 is a front perspective view of an embodiment of the automated sandwich wrapping system of FIG. 1 with the upper roller subassembly in the closed position, the creasing blade subassembly in the rear horizontal position, each of the left folding flap and the right folding flap in the coplanar position, each of the left upper folding plate and the right upper folding plate in the idle position, each of the left lower folding plate and the right lower folding plate in the idle position, and each of the left plunger and the right plunger in the retracted position.
Figure 16:
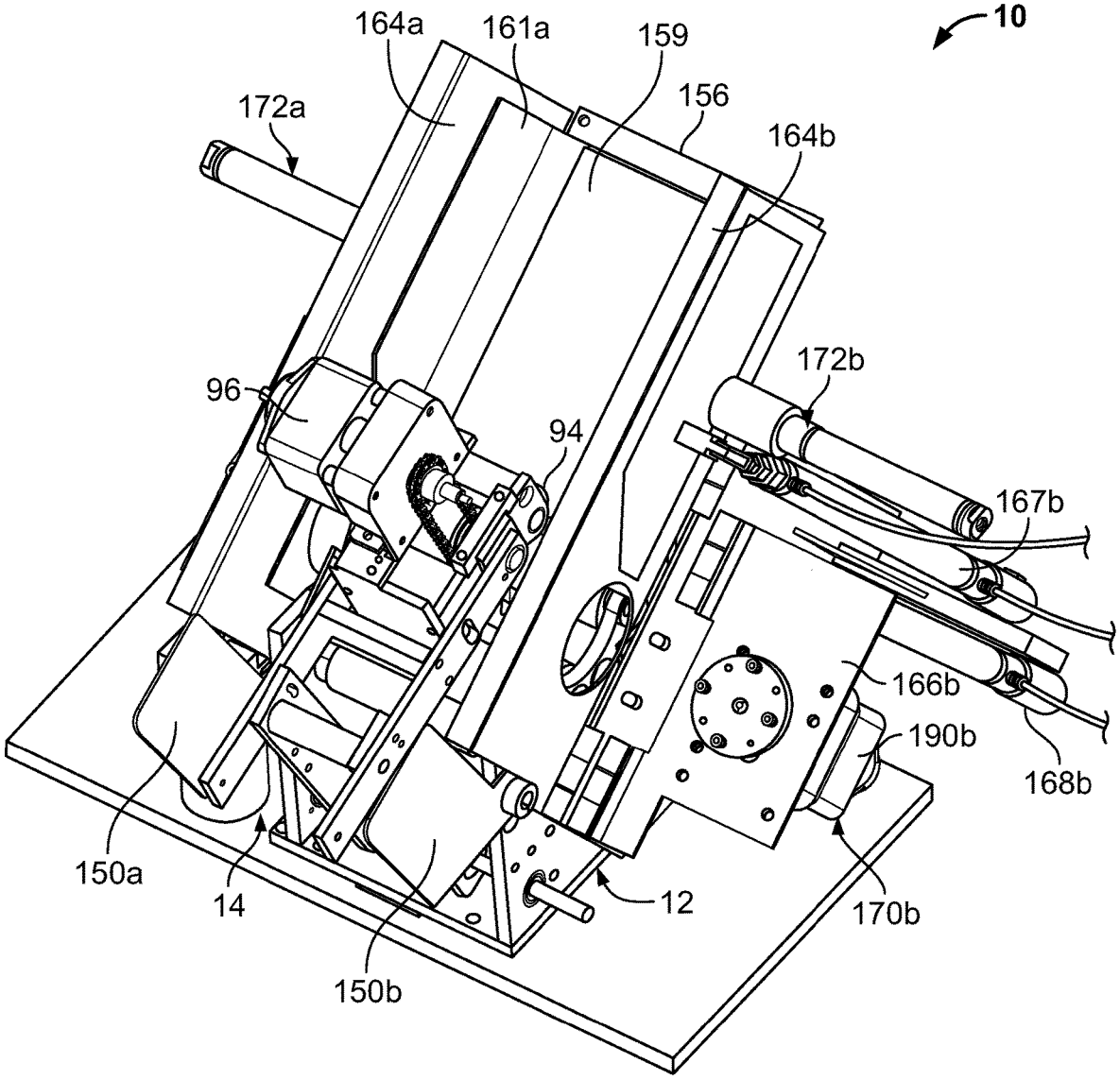
FIG. 16 is a front perspective view of an embodiment of the automated sandwich wrapping system of FIGS. 1 and 15 with the upper roller subassembly in the closed position, the creasing blade subassembly in the front vertical position, each of the left folding flap and the right folding flap in the perpendicular position, each of the left upper folding plate and the right upper folding plate in the active position, each of the left lower folding plate and the right lower folding plate in the active position, and the left plunger and the right plunger in the retracted position.
Figure 17:
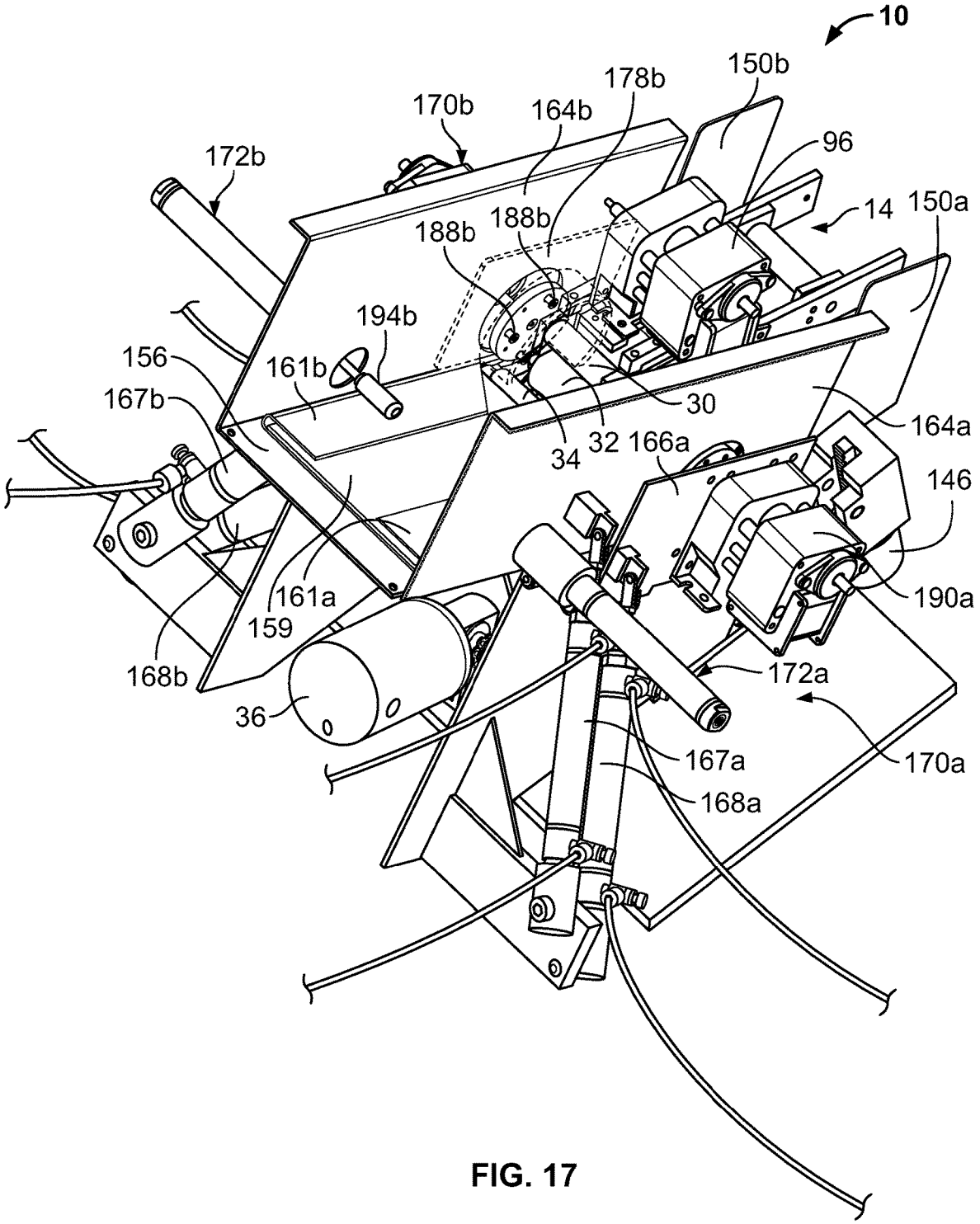
FIG. 17 is a rear perspective view of an embodiment of the automated sandwich wrapping system of FIGS. 1 and 15-16 with the upper roller subassembly in the closed position, the creasing blade subassembly in the front vertical position, each of the left folding flap and the right folding flap in the folded position, each of the left upper folding plate and the right upper folding plate in the active position, each of the left lower folding plate and the right lower folding plate in the active position, and each of the left plunger and the right plunger in the extended position.
Figure 18:
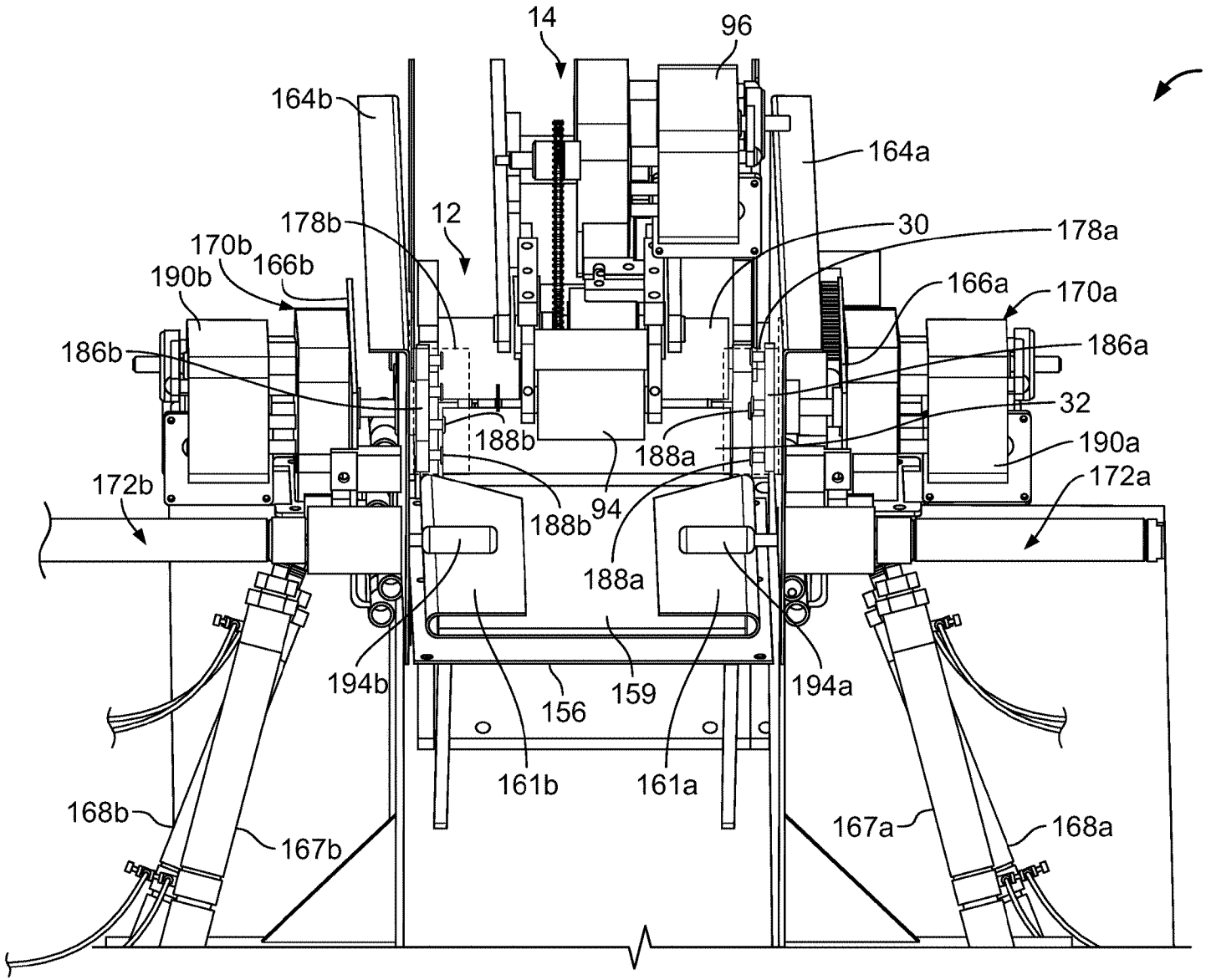
FIG. 18 is a top plan view of an embodiment of the automated sandwich wrapping system of FIGS. 1 and 17.

FIGS. 15-18 are views illustrating use of the automated sandwich wrapping system 10 with components thereof in various positions. More specifically, FIG. 15 is a front perspective view of an embodiment of the automated sandwich wrapping system of FIG. 1 with the upper roller subassembly in the closed position, the creasing blade subassembly in the rear horizontal position, each of the left folding flap and the right folding flap in the coplanar position, each of the left upper folding plate and the right upper folding plate in the idle position, each of the left lower folding plate and the right lower folding plate in the idle position, and each of the left extendable plunger arm and the right extendable plunger arm in the retracted position, FIG. 16 is a front perspective view of an embodiment of the automated sandwich wrapping system of FIGS. 1 and 15 with the upper roller subassembly in the closed position, the creasing blade subassembly in the front vertical position, each of the left folding flap and the right folding flap in the perpendicular position, each of the left upper folding plate and the right upper folding plate in the active position, each of the left lower folding plate and the right lower folding plate in the active position, and the left plunger and the right plunger in the retracted position, FIG. 17 is a rear perspective view of an embodiment of the automated sandwich wrapping system of FIGS. 1 and 15-16 with the upper roller subassembly in the closed position, the creasing blade subassembly in the front vertical position, each of the left folding flap and the right folding flap in the folded position, each of the left upper folding plate and the right upper folding plate in the active position, each of the left lower folding plate and the right lower folding plate in the active position, and each of the left plunger and the right plunger in the extended position, and FIG. 18 is a top plan view of an embodiment of the automated sandwich wrapping system of FIGS. 1 and 17.

To use the automated sandwich wrapping system 10, the upper roller subassembly 14 is in the open position, the left creasing blade 150*a* and the right creasing blade 150*b* are in the vertical position, the left folding flap 161*a* and right folding flap 161*b* are in the coplanar position, the left upper folding plate 164*a* and right upper folding plate 164*b* are in the idle position, and the left lower folding plate 166*a* and right lower folding plate 166*b* are in the idle position (e.g., as shown in FIG. 1). With these components in these positions, one or more pieces and/or types of sandwich wrapping paper (or other type of wrapping material) is positioned between the folding panel 156 and the sandwich wrapping paper stabilizing clip 159, such that at least a first portion of the sandwich wrapping paper extends onto at least a portion of the lower roller subassembly 12 (e.g., the first lower driven roller 30, second lower driven roller 32, and/or lower support roller 34). A sandwich (or other item to be wrapped) is then positioned on top of the first portion of the sandwich wrapping paper extending onto the lower roller subassembly 12. A second portion of the sandwich wrapping paper (e.g., extending from the first portion) is then positioned over the sandwich.

As shown in FIG. 15, with the sandwich wrapping paper and sandwich set up in the automated sandwich wrapping system 10, the upper roller subassembly 14 moves (e.g., manually or automatically) from the open position to the closed position. Accordingly, the first upper driven roller 92 (not shown) and second upper driven roller 94 contact the second portion of the sandwich wrapping paper, such that the sandwich is at least partially surrounded by the first portion of the sandwich wrapping paper and the second portion of the sandwich wrapping paper and secured between the lower roller subassembly 12 and the upper roller subassembly 14.

Once the sandwich is positioned in the sandwich wrapping paper (forming a cylindrical shape with open ends), the creasing blade drive motor 146 actuates to rotate the left creasing blade 150*a* and right creasing blade 150*b* from a front vertical position to a rear horizontal position, as shown in FIG. 15. This creases the sandwich wrapping paper extending past the left and right ends of the sandwich. As shown in FIG. 16, the creasing blade drive motor 146 actuates again to rotate the left creasing blade 150*a* and right creasing blade 150*b* from a rear horizontal position back to a front vertical position.

As shown in FIG. 16, during or after rotative retraction of the left creasing blade 150*a* and right creasing blade 150*b*, the left upper folding plate piston 167*a* actuates (e.g., extends) to move the left upper folding plate 164*a* from an idle position to an active position, which moves the left folding flap 161*a* from a coplanar position to a perpendicular position. As a result, the left sandwich guard 178*a* folds the sandwich wrapping paper (e.g., at the crease created by the left creasing blade 150*a* and right creasing blade 150*b*) inwardly, such that the sandwich wrapping paper extending past the left end of the sandwich folds back over onto itself. Further, the sandwich wrapping paper extending past the left edge of the sandwich wrapping paper stabilizing clip 159 (e.g., the sandwich wrapping paper extending onto the left folding flap 161*a* and/or left upper folding plate 164*a*) is folded to a generally perpendicular position by the left folding flap 161*a* and/or left upper folding plate 164*a*.

Similarly, during or after rotative retraction of the left creasing blade 150*a* and right creasing blade 150*b*, the right upper folding plate piston 167*b* actuates (e.g., extends) to move the right upper folding plate 164*b* from an idle position to an active position, which moves the right folding flap 161*b* from a coplanar position to a perpendicular position. As a result, the right sandwich guard 178*b* folds the sandwich wrapping paper (e.g., at the crease created by the left creasing blade 150*a* and right creasing blade 150*b*) inwardly, such that the sandwich wrapping paper extending past the right end of the sandwich folds back over onto itself. Further, the sandwich wrapping paper extending past the right edge of the sandwich wrapping paper stabilizing clip 159 (e.g., the sandwich wrapping paper extending onto the right folding flap 161*b* and/or right upper folding plate 164*b*) is folded to a generally perpendicular position by the right folding flap 161*b* and/or right upper folding plate 164*b*.

As shown in FIG. 17, the left plunger 172*a* actuates to extend the left extendable plunger arm 194*a*, which moves the left folding flap 161*a* from the perpendicular position to the folded position. As a result, the left side of the sandwich wrapping paper extending onto the left folding flap 161*a* folds back on itself (e.g., folds inwardly). Similarly, as also shown in FIG. 17, the right plunger 172*b* actuates to extend the right extendable plunger arm 194*b*, which moves the right folding flap 161*b* from the perpendicular position to the folded position. As a result, the right side of the sandwich wrapping paper extending onto the right folding flap 161*b* folds back on itself (e.g., folds inwardly).

During or after actuation of the left plunger 172*a* and right plunger 172*b*, the left lower folding plate piston 168*a* actuates (e.g., extends) to move the left lower folding plate 166*a* from the idle position to the active position. This causes the left gripping fingers 188*a* of the left gripper 170*a* to engage the left side of the sandwich. Similarly, during or after actuation of the left plunger 172*a* and right plunger 172*b*, the right lower folding plate piston 168*b* actuates (e.g., extends) to move the right lower folding plate 166*b* from the idle position to the active position. This causes the right gripping fingers 188*b* of the right gripper 170*b* to engage the right side of the sandwich.

As shown in FIG. 18, the sandwich would be covered substantially along its axis by the first lower driven roller 30, the second lower driven roller 32, the lower support roller 34, the upper driven roller 92, the second upper driven roller 94, the left sandwich guard 178*a*, and the right sandwich guard 178*b*. The lower roller drive motor 36 actuates (e.g., to rotate the first lower driven roller 30 and the second lower driven roller 32), the upper roller drive motor 96 actuates (e.g., to rotate the first upper driven roller 92 and the second upper driven roller 94), the left gripper motor 190*a* actuates (e.g., to rotate the left rotatable gripper plate 186*a* and corresponding left gripping fingers 188*a*), and/or the right gripper motor 190*b* actuates (e.g., to rotate the right rotatable gripper plate 186*b* and corresponding right gripping fingers 188*b*). This rotates the sandwich, thereby wrapping the sandwich in the sandwich wrapping paper, which results in little or no excess sandwich wrapping paper extending past the ends of the sandwich. The lower roller drive motor 36, the upper roller drive motor 96, the left gripper motor 190*a*, and/or the right gripper motor 190*b* can be synchronized in the sense that they ensure their respective components rotate the sandwich at the same speed. Such synchronization can be controlled by an electronic controller (e.g., computer system).

Figure 19:
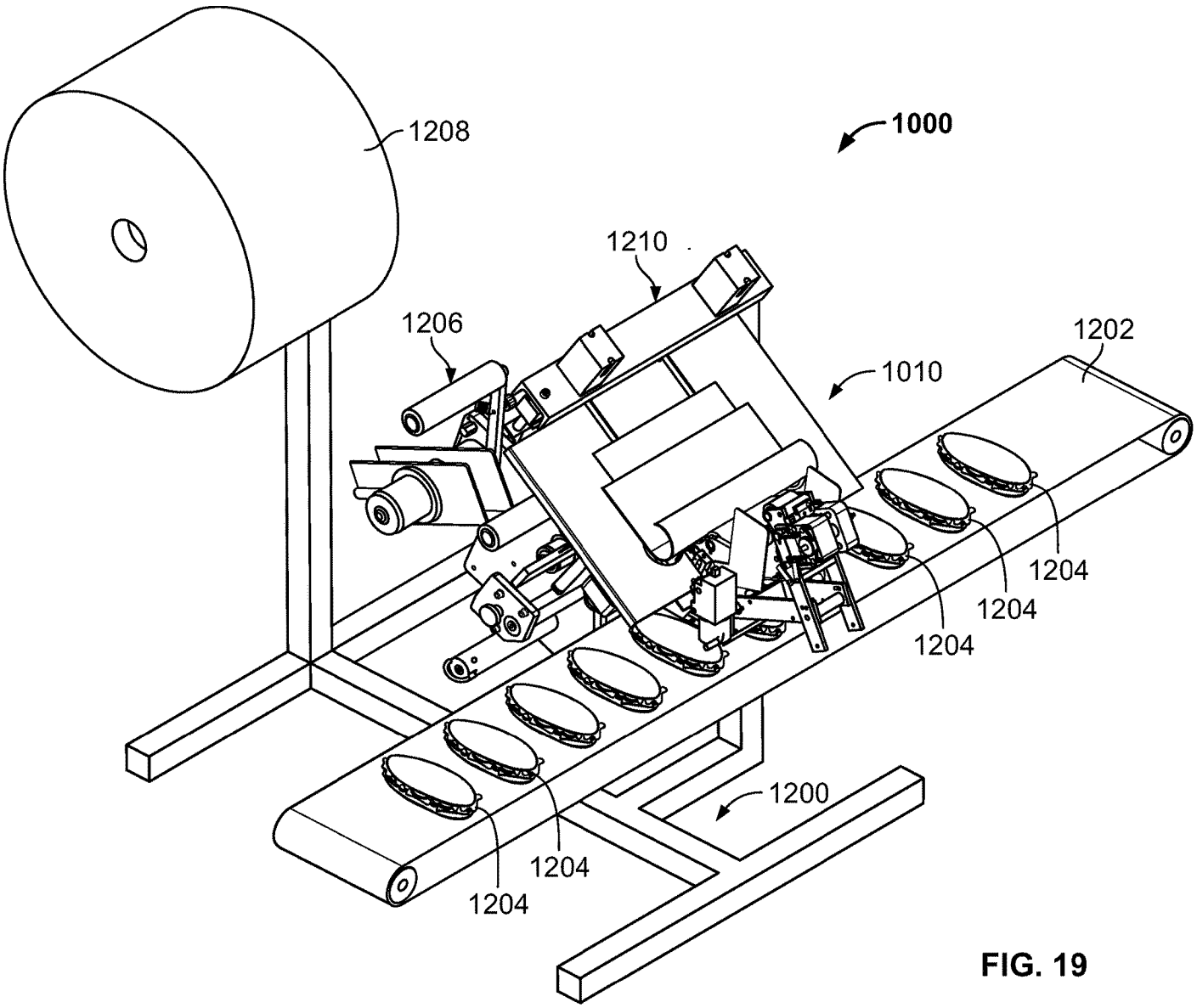
FIG. 19 is a front perspective view of an embodiment of the automated sandwich wrapping system of FIG. 1 in combination with a support structure, conveyer belt, label machine, wrapping paper roll, and wrapping paper cutting apparatus.
Figure 20:
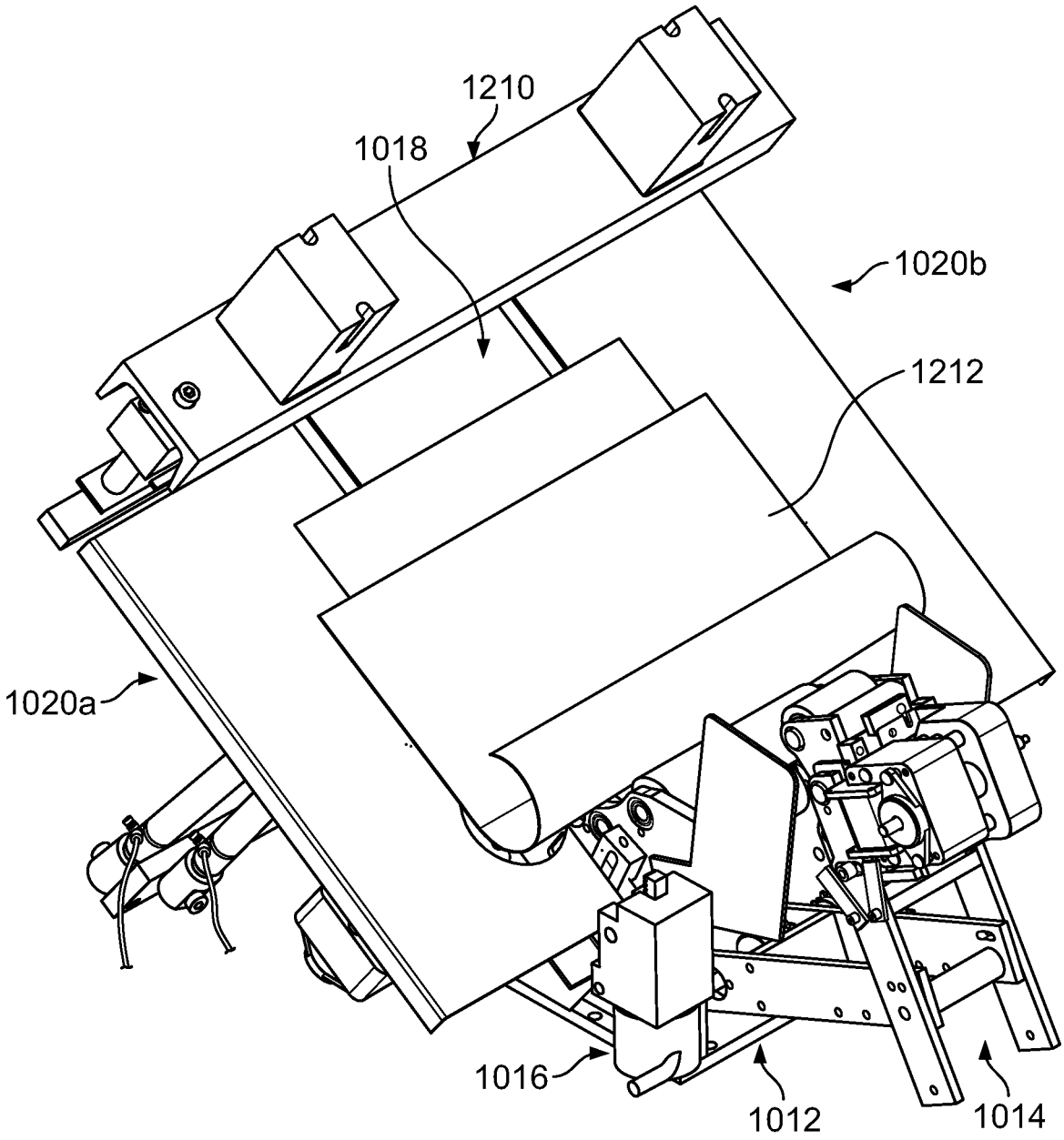
FIG. 20 is front perspective view of an embodiment of the automated sandwich wrapping system of FIGS. 1 and 19.
Figure 21:
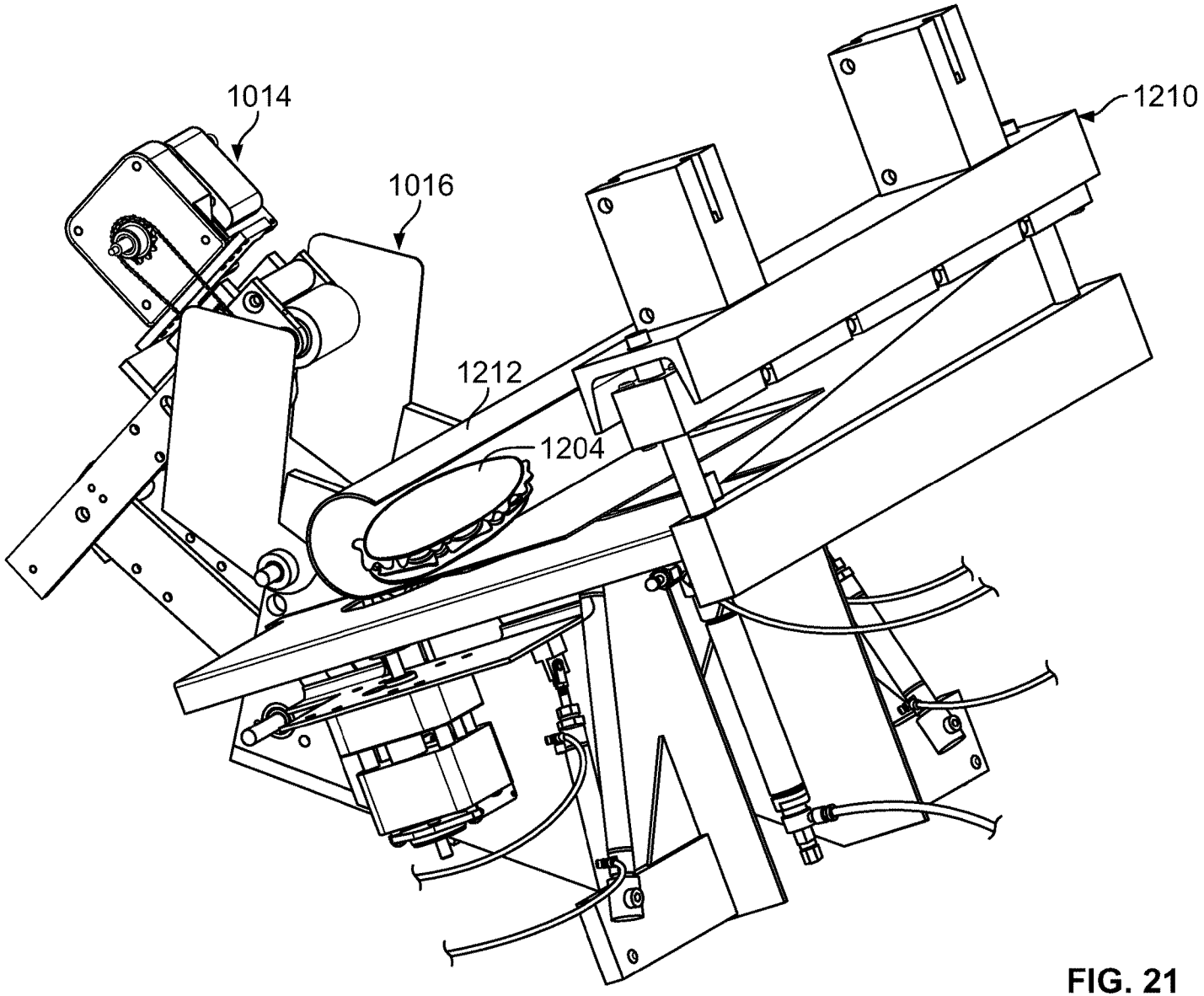
FIG. 21 is rear perspective view of an embodiment of the automated sandwich wrapping system of FIGS. 1 and 19-20.

FIGS. 19-22 are views of an automated sandwich wrapping system 1000. More specifically, FIG. 19 is a front perspective view of an embodiment of the automated sandwich wrapping system of FIG. 1 in combination with a support structure, conveyer belt, label machine, wrapping paper roll, and wrapping paper cutting apparatus, FIG. 20 is front perspective view of an embodiment of the automated sandwich wrapping system of FIGS. 1 and 19, FIG. 21 is rear perspective view of an embodiment of the automated sandwich wrapping system of FIGS. 1 and 19-20, and FIG. 22 is a side elevational view of an embodiment of the automated sandwich wrapping system of FIGS. 1 and 19-21.

As shown in FIG. 19, the automated sandwich wrapping system 1000 includes the automated sandwich wrapping system 1010. The automated sandwich wrapping system 1010 is as described above with respect to FIGS. 1-18. The automated sandwich wrapping system 1010 includes a lower roller subassembly 1012, an upper roller subassembly 1014, a creasing blade subassembly 1016, a sandwich wrapping paper support subassembly 1018, a left folding subassembly 1020*a*, and a right folding subassembly 1020*b*, as described above with respect to FIGS. 1-18.

The automated sandwich wrapping system 1000 includes a support structure 1200 to mount the various components of the automated sandwich wrapping system 1000 thereto (e.g., including the automated sandwich wrapping system 1010. The automated sandwich wrapping system 1000 includes a conveyer belt 1202 positioned in front of the automated sandwich wrapping system 1010, the conveyor belt 1202 transporting a plurality of sandwiches 1204 (e.g., wrapped and/or unwrapped) which can be loaded (e.g., manually or automatically) into the automated sandwich wrapping system 1010.

The automated sandwich wrapping system 1000 can include a label machine 1206 which can apply labels onto the wrapped sandwiches after they have been wrapped by the automated sandwich wrapping system 1010. The label machine 1206 can be positioned behind and/or beneath the automated sandwich wrapping system 1010. The label machine 1206 can apply labels through the space between the lower roller subassembly 1012 and the sandwich wrapping paper support subassembly 1018.

The automated sandwich wrapping system 1000 can also include a sandwich wrapping paper roll 1208 and sandwich wrapping paper cutting apparatus 1210. The sandwich wrapping paper roll 1208 can be mounted onto the support structure 1200 and positioned behind the automated sandwich wrapping system 1010. The sandwich wrapping paper cutting apparatus 1210 can be mounted to the support structure 1200 and/or the automated sandwich wrapping system 1010 at approximately the rear of the automated sandwich wrapping system 1010 (e.g., between the automated sandwich wrapping system 1010 and the sandwich wrapping paper roll 1208. In this way, sandwich wrapping paper from the sandwich wrapping paper roll 1208 can be fed through the sandwich wrapping paper cutting apparatus 1210 onto the sandwich wrapping paper support assembly 1018 of the automated sandwich wrapping system 1010, and the sandwich wrapping paper cutting apparatus 1210 can cut a piece of sandwich wrapping paper 1212 from the sandwich wrapping paper roll 1208.

Figure 22:
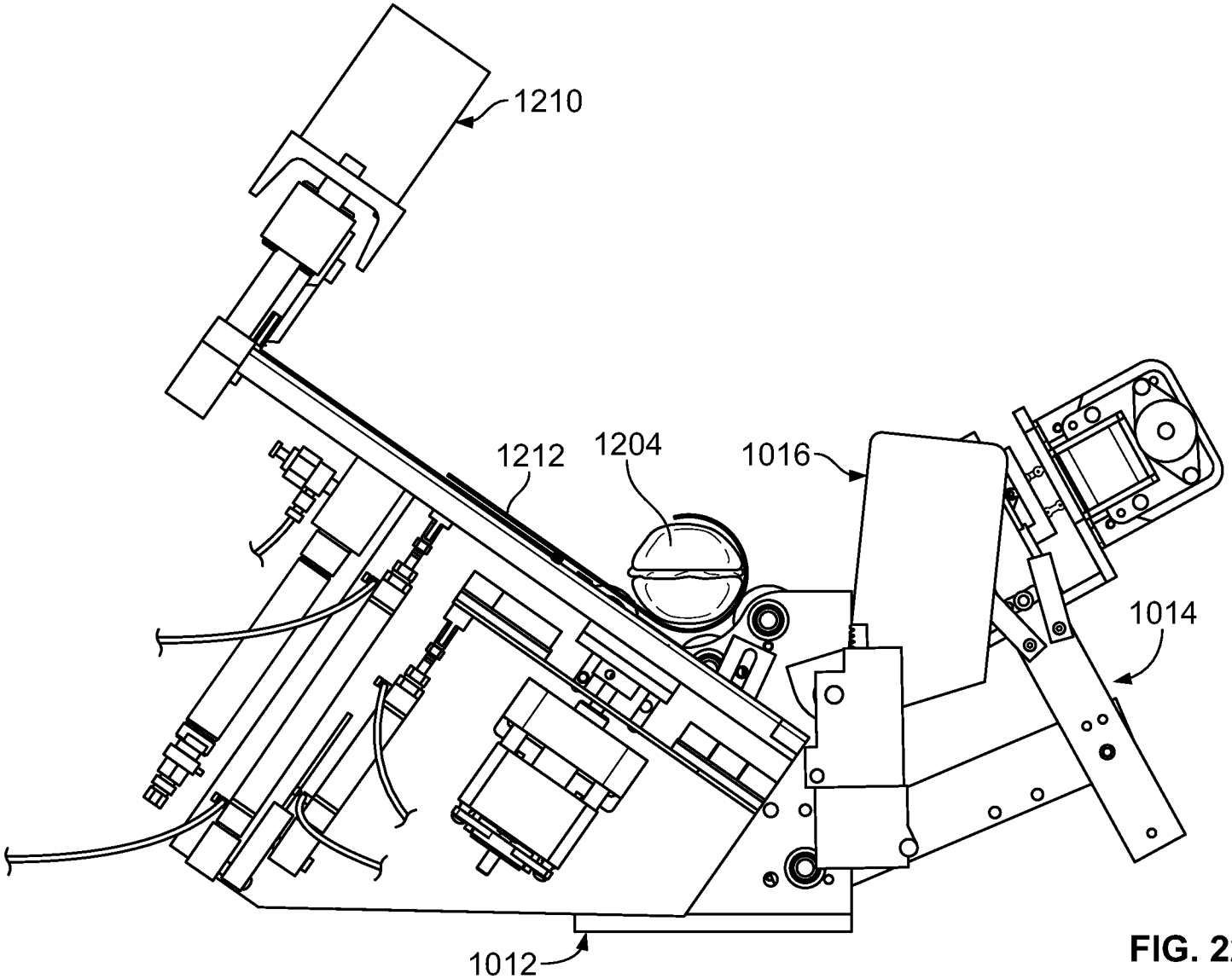
FIG. 22 is a side elevational view of an embodiment of the automated sandwich wrapping system of FIGS. 1 and 19-21.

As shown in FIGS. 20-22, once a cut piece of sandwich wrapping paper 1212 is removed from the sandwich wrapping paper roll 1208 (e.g., manually or automatically) a sandwich 1204 is placed (e.g., manually or automatically) onto the cut piece of sandwich wrapping paper 1212 above the lower roller subassembly 1012. A portion of the cut piece of sandwich wrapping paper 1212 is then positioned (e.g., manually or automatically) over the sandwich 1204, such that a portion of the cut piece of sandwich wrapping paper 1212 substantially covers the sandwich 1204. Wrapping the sandwich 1204 can proceed as discussed above with respect to FIGS. 15-18.

Having thus described the invention in detail, it is to be understood that the foregoing description is not intended to limit the spirit or scope thereof. It will be understood that the embodiments of the present invention described herein are merely exemplary and that a person skilled in the art may make many variations and modification without departing from the spirit and scope of the invention. All such variations and modifications, including those discussed above, are intended to be included within the scope of the invention.

What is claimed is:

1. An automated sandwich wrapping system, comprising:

a folding subassembly having a plurality of folding plates to inwardly fold side portions of sandwich wrapping paper extending past ends of a sandwich, the folding plates moving between an idle position and an active position;

a left gripper and a right gripper configured to engage the ends of the sandwich to rotate and facilitate wrapping the sandwich;

a roller subassembly having at least one roller to rotate the sandwich to wrap the sandwich; and a controller preprogrammed to control and coordinate operation of the folding subassembly and the roller subassembly.

2. The automated sandwich wrapping system of claim 1, wherein the folding subassembly comprises a left folding subassembly having a left upper folding plate and a right folding subassembly having a right upper folding plate to inwardly fold side portions of the sandwich wrapping paper extending past the ends of the sandwich, and wherein the folding subassembly comprises a left lower folding plate with the left gripper mounted thereto and a right lower folding plate with the right gripper mounted thereto, the left lower folding plate and right lower folding plate moving between an idle position and an active position to align and engage the left gripper and the right gripper with the ends of the sandwich.

3. The automated sandwich wrapping system of claim 1, wherein the folding subassembly comprises a left folding subassembly having a left folding plate and a right folding subassembly having a right folding plate to inwardly fold left and right side portions of the sandwich wrapping paper extending past the ends of the sandwich as the sandwich wrapping paper is being wrapped around the sandwich.

4. The automated sandwich wrapping system of claim 3, wherein the left folding plate includes a left opening and the right folding plate includes a right opening to receive the ends of the sandwich when the left folding plate and the right folding plate are in the active position.

5. The automated sandwich wrapping system of claim 4, further comprising a left sandwich guard extending from at least a portion of a perimeter of the left opening, and a right sandwich guard extending from at least a portion of a perimeter of the right opening, the left sandwich guard and the right sandwich guard facilitating wrapping at the ends of the sandwich by further folding the sandwich wrapping paper extending past the ends of the sandwich back over onto itself.

6. The automated sandwich wrapping system of claim 3, wherein the idle position includes the left folding plate coplanar with the right folding plate, and wherein the active position includes the left folding plate parallel with the right folding plate.

7. The automated sandwich wrapping system of claim 3, wherein the left folding subassembly comprises the left gripper having a rotatable plate to engage and rotate an end of the sandwich, and the right folding subassembly comprises the right gripper having a rotatable plate to engage and rotate an end of the sandwich.

8. The automated sandwich wrapping system of claim 3, comprising a sandwich wrapping paper support subassembly positioned between the left folding subassembly and the right folding subassembly to feed the sandwich wrapping paper during wrapping.

9. The automated sandwich wrapping system of claim 8, wherein the sandwich wrapping paper support subassembly comprises a folding panel having a left folding flap and a right folding flap to inwardly fold side portions of sandwich wrapping paper extending past ends of the sandwich onto itself prior to those portions being wrapped around the sandwich.

10. The automated sandwich wrapping system of claim 9, wherein the left folding subassembly includes a left plunger with a left extendable plunger arm and the right folding subassembly includes a right plunger with a right extendable plunger arm to fold the left folding flap and the right folding flap of the folding panel.

11. The automated sandwich wrapping system of claim 10, wherein the left extendable plunger arm moves the left folding flap from a perpendicular position partially folding the sandwich wrapping paper to a folded position thereby folding side portions of the sandwich wrapping paper back onto itself prior to those portions being wrapped around the sandwich, and wherein the right extendable plunger arm moves the right folding flap from a perpendicular position partially folding the sandwich wrapping paper to a folded position thereby folding side portions of the sandwich wrapping paper back onto itself prior to those portions being wrapped around the sandwich.

12. The automated sandwich wrapping system of claim 1, wherein the roller subassembly comprises a lower roller subassembly having a plurality of lower rollers and an upper roller subassembly having a plurality of upper rollers, the plurality of lower rollers and the plurality of upper rollers engaging the sandwich to rotate the sandwich to wrap the sandwich.

13. The automated sandwich wrapping system of claim 12, wherein the lower roller subassembly comprises a lower roller drive motor, the upper roller subassembly comprises an upper roller drive motor, and the lower roller drive motor and the upper roller drive motor are synchronized.

14. The automated sandwich wrapping system of claim 12, wherein the upper roller subassembly is pivotally attached to the lower roller subassembly to releasably secure the sandwich and sandwich wrapping paper therebetween.

15. The automated sandwich wrapping system of claim 1, comprising a creasing blade subassembly to crease sides of the sandwich wrapping paper extending past the ends of the sandwich, wherein the creasing blade subassembly creases the sandwich wrapping paper at approximately the ends of the sandwich.

16. An automated sandwich wrapping system, comprising:

a sandwich wrapping paper support subassembly having a sandwich wrapping paper feeder plate to feed the sandwich wrapping paper during wrapping;

a creasing blade subassembly having a left creasing blade and a right creasing blade to crease side portions of sandwich wrapping paper extending past ends of a sandwich;

a left folding subassembly having a left lower folding plate and a left upper folding plate to inwardly fold left side portions of sandwich wrapping paper extending past a left end of the sandwich, the left folding subassembly positioned adjacent to a left side of the sandwich wrapping paper support subassembly;

a right folding subassembly having a right lower folding plate and a right upper folding plate to inwardly fold right side portions of sandwich wrapping paper extending past a right end of the sandwich, the right folding subassembly positioned adjacent a right side of the sandwich wrapping paper support subassembly;

a lower roller subassembly having a plurality of lower rollers to rotate the sandwich to wrap the sandwich;

an upper roller subassembly pivotally attached to the lower roller subassembly, the upper roller subassembly having a plurality of upper rollers to rotate the sandwich to wrap the sandwich; and a controller preprogrammed to control and coordinate operation of the creasing blade subassembly, the left folding subassembly, the right folding subassembly, the lower roller subassembly, and the upper roller subassembly.

17. The automated sandwich wrapping system of claim 16, wherein the left folding subassembly comprises a left gripper mounted to the left lower folding plate, and wherein the right folding subassembly comprises a right gripper mounted to the right lower folding plate, the left gripper and the right gripper hingedly movable to engage ends of the sandwich to rotate the sandwich to wrap the sandwich.

18. The automated sandwich wrapping system of claim 16, wherein the left upper folding plate defines a left opening, and wherein the right upper folding plate defines a right opening to receive ends of the sandwich when the left folding plate and the right folding plate are in the active position.

19. The automated sandwich wrapping system of claim 16, comprising a folding panel, the folding panel having a left folding flap and a right folding flap to inwardly fold side portions of sandwich wrapping paper extending past ends of a sandwich onto itself prior to being wrapped around the sandwich.

20. An automated method of wrapping a sandwich, comprising:

introducing a sandwich into an automated sandwich wrapping system, the automated sandwich wrapping system including (i) a folding subassembly having a plurality of folding plates, (ii) a left gripper, (iii) a right gripper, (iv) a roller subassembly having at least one roller, and v) a controller;

controlling and coordinating operation of the folding subassembly, the left gripper, the right gripper, and the roller subassembly with the controller to:

move one or more of the plurality of folding plates of the folding subassembly between an idle position and an active position to inwardly fold side portions of sandwich wrapping paper extending past ends of the sandwich;

engage the ends of the sandwich with the left and right grippers and rotate the sandwich with the left and right grippers; and rotate the sandwich with the at least one roller of the roller subassembly to wrap the sandwich.

* * * * *